US008412593B1

(12) United States Patent
Song et al.

(10) Patent No.: US 8,412,593 B1
(45) Date of Patent: Apr. 2, 2013

(54) CREDIT CARD MATCHING

(75) Inventors: Jennifer Jungsun Song, Los Angeles, CA (US); David C. Cantrell, Stevenson Ranch, CA (US)

(73) Assignee: LowerMyBills.com, Inc., Santa Monica, CA (US)

( * ) Notice: Subject to any disclaimer, the term of this patent is extended or adjusted under 35 U.S.C. 154(b) by 642 days.

(21) Appl. No.: 12/575,404

(22) Filed: Oct. 7, 2009

Related U.S. Application Data

(60) Provisional application No. 61/103,528, filed on Oct. 7, 2008.

(51) Int. Cl.
*G06Q 30/00* (2006.01)

(52) U.S. Cl. ..... 705/27.1; 705/35

(58) Field of Classification Search ..... 705/26.1–27.2, 705/35

See application file for complete search history.

(56) References Cited

U.S. PATENT DOCUMENTS

| | | | |
|---|---|---|---|
| 3,316,395 | A | 4/1967 | Lavin |
| 4,491,725 | A | 1/1985 | Pritchard |
| 4,775,935 | A | 10/1988 | Yourick |
| 4,812,628 | A | 3/1989 | Boston et al. |
| 4,872,113 | A | 10/1989 | Dinerstein |
| 4,947,028 | A | 8/1990 | Gorog |
| 4,982,346 | A | 1/1991 | Girouard et al. |
| 5,201,010 | A | 4/1993 | Deaton et al. |
| 5,239,462 | A | 8/1993 | Jones et al. |
| 5,283,731 | A | 2/1994 | Lalonde et al. |
| 5,301,105 | A | 4/1994 | Cummings, Jr. |
| 5,305,195 | A | 4/1994 | Murphy |
| 5,459,306 | A | 10/1995 | Stein et al. |
| 5,515,098 | A | 5/1996 | Carles |
| 5,557,514 | A | 9/1996 | Seare et al. |
| 5,583,760 | A | 12/1996 | Klesse |
| 5,590,038 | A | 12/1996 | Pitroda |
| 5,592,560 | A | 1/1997 | Deaton et al. |
| 5,611,052 | A | 3/1997 | Dykstra et al. |
| 5,640,577 | A | 6/1997 | Scharmer |
| 5,644,778 | A | 7/1997 | Burks et al. |
| 5,661,516 | A | 8/1997 | Carles |

(Continued)

FOREIGN PATENT DOCUMENTS

| | | |
|---|---|---|
| CN | 1290372 | 5/2001 |
| EP | 0 749 081 | 12/1966 |

(Continued)

OTHER PUBLICATIONS

Littwin, Angela Texas Law Review v86n3 pp. 451-506 Feb. 2008.*

(Continued)

*Primary Examiner* — Jeffrey A Smith
*Assistant Examiner* — Resha Desai
(74) *Attorney, Agent, or Firm* — Knobbe, Martens, Olson & Bear, LLP

(57) ABSTRACT

A consumer provides authorization to a card match system to access the consumer's credit file to match the consumer to one or more credit cards. The consumer's credit score is retrieved and then compared to the acceptable credit score range for each of a plurality of credit cards. The consumer is notified of any matches. If one or more matches are found, a prescreened matching of the consumer to one or more credit cards is requested, without authorization from the consumer and without notifying the consumer that the prescreening is being performed. The consumer may then be notified of the matches found by the first comparison that are based on the credit score and of the matches found by the more detailed comparison based on the attributes of the consumer's credit file.

13 Claims, 14 Drawing Sheets

U.S. PATENT DOCUMENTS

| | | | |
|---|---|---|---|
| 5,699,527 | A | 12/1997 | Davidson |
| 5,704,044 | A | 12/1997 | Tarter et al. |
| 5,724,521 | A | 3/1998 | Dedrick |
| 5,740,549 | A | 4/1998 | Reilly et al. |
| 5,764,923 | A | 6/1998 | Tallman et al. |
| 5,832,447 | A | 11/1998 | Rieker et al. |
| 5,844,218 | A | 12/1998 | Kawan et al. |
| 5,848,396 | A | 12/1998 | Gerace |
| 5,857,175 | A | 1/1999 | Day et al. |
| 5,870,721 | A | 2/1999 | Norris |
| 5,873,068 | A | 2/1999 | Beaumont et al. |
| 5,878,403 | A | 3/1999 | DeFrancesco |
| 5,884,287 | A | 3/1999 | Edesess |
| 5,907,828 | A | 5/1999 | Meyer et al. |
| 5,926,800 | A | 7/1999 | Baronowski et al. |
| 5,930,759 | A | 7/1999 | Moore et al. |
| 5,930,776 | A | 7/1999 | Dykstra et al. |
| 5,933,809 | A | 8/1999 | Hunt et al. |
| 5,940,812 | A | 8/1999 | Tengel et al. |
| 5,944,790 | A | 8/1999 | Levy |
| 5,956,693 | A | 9/1999 | Geerlings |
| 5,966,699 | A | 10/1999 | Zandi |
| 5,970,478 | A | 10/1999 | Walker et al. |
| 5,990,038 | A | 11/1999 | Suga et al. |
| 5,991,735 | A | 11/1999 | Gerace |
| 5,995,947 | A | 11/1999 | Fraser et al. |
| 6,014,632 | A | 1/2000 | Gamble et al. |
| 6,018,723 | A | 1/2000 | Siegel et al. |
| 6,029,149 | A | 2/2000 | Dykstra et al. |
| 6,038,551 | A | 3/2000 | Barlow et al. |
| 6,044,351 | A | 3/2000 | Jones |
| 6,044,352 | A | 3/2000 | Deavers |
| 6,067,522 | A | 5/2000 | Warady et al. |
| 6,070,147 | A | 5/2000 | Harms et al. |
| 6,073,104 | A | 6/2000 | Field |
| 6,088,686 | A | 7/2000 | Walker et al. |
| 6,098,052 | A | 8/2000 | Kosiba et al. |
| 6,101,486 | A | 8/2000 | Roberts et al. |
| 6,108,641 | A | 8/2000 | Kenna et al. |
| 6,129,273 | A | 10/2000 | Shah |
| 6,144,948 | A | 11/2000 | Walker et al. |
| 6,163,770 | A | 12/2000 | Gamble et al. |
| 6,171,112 | B1 | 1/2001 | Clark et al. |
| 6,185,543 | B1 | 2/2001 | Galperin et al. |
| 6,208,973 | B1 | 3/2001 | Boyer et al. |
| 6,208,979 | B1 | 3/2001 | Sinclair |
| 6,236,977 | B1 | 5/2001 | Verba et al. |
| 6,289,318 | B1 | 9/2001 | Barber |
| 6,298,330 | B1 | 10/2001 | Gardenswartz et al. |
| 6,311,169 | B2 | 10/2001 | Duhon |
| 6,317,752 | B1 | 11/2001 | Lee et al. |
| 6,324,566 | B1 | 11/2001 | Himmel et al. |
| 6,334,110 | B1 | 12/2001 | Walter et al. |
| 6,374,229 | B1 | 4/2002 | Lowrey et al. |
| 6,374,230 | B1 | 4/2002 | Walker et al. |
| 6,385,592 | B1 | 5/2002 | Angles et al. |
| 6,385,594 | B1 | 5/2002 | Lebda et al. |
| 6,405,181 | B2 | 6/2002 | Lent et al. |
| 6,442,577 | B1 | 8/2002 | Britton et al. |
| 6,453,297 | B1 | 9/2002 | Burks et al. |
| 6,456,983 | B1 | 9/2002 | Keyes et al. |
| 6,460,036 | B1 | 10/2002 | Herz |
| 6,513,018 | B1 | 1/2003 | Culhane |
| 6,587,841 | B1 | 7/2003 | DeFrancesco et al. |
| 6,598,030 | B1 | 7/2003 | Siegel et al. |
| 6,611,816 | B2 | 8/2003 | Lebda et al. |
| 6,615,247 | B1 | 9/2003 | Murphy |
| 6,623,529 | B1 | 9/2003 | Lakritz |
| 6,640,215 | B1 | 10/2003 | Galperin et al. |
| 6,665,715 | B1 | 12/2003 | Houri |
| 6,684,093 | B2 | 1/2004 | Kuth |
| 6,757,740 | B1 | 6/2004 | Parekh et al. |
| 6,804,346 | B1 | 10/2004 | Mewhinney |
| 6,810,356 | B1 | 10/2004 | Garcia-Franco et al. |
| 6,826,535 | B2 | 11/2004 | Wood et al. |
| 6,847,942 | B1 | 1/2005 | Land et al. |
| 6,901,406 | B2 | 5/2005 | Nabe et al. |
| 6,910,624 | B1 | 6/2005 | Natsuno |
| 6,925,441 | B1 | 8/2005 | Jones, III et al. |
| 6,934,714 | B2 | 8/2005 | Meinig |
| 6,959,281 | B1 | 10/2005 | Freeling et al. |
| 6,983,478 | B1 | 1/2006 | Grauch et al. |
| 6,985,887 | B1 | 1/2006 | Sunstein et al. |
| 7,003,491 | B2 | 2/2006 | Starkman |
| 7,003,792 | B1 | 2/2006 | Yuen |
| 7,033,792 | B2 | 4/2006 | Zhong et al. |
| 7,072,842 | B2 | 7/2006 | Provost et al. |
| 7,072,853 | B2 | 7/2006 | Shkedi |
| 7,072,909 | B2 | 7/2006 | Polk |
| 7,072,963 | B2 | 7/2006 | Anderson et al. |
| 7,133,840 | B1 | 11/2006 | Kenna et al. |
| 7,150,030 | B1 | 12/2006 | Eldering et al. |
| 7,152,018 | B2 | 12/2006 | Wicks |
| 7,152,237 | B2 | 12/2006 | Flickinger et al. |
| 7,171,371 | B2 | 1/2007 | Goldstein |
| 7,174,302 | B2 | 2/2007 | Patricelli et al. |
| 7,181,427 | B1 | 2/2007 | DeFrancesco |
| 7,185,353 | B2 | 2/2007 | Schlack |
| 7,191,150 | B1 | 3/2007 | Shao et al. |
| 7,191,451 | B2 | 3/2007 | Nakagawa |
| 7,197,468 | B1 | 3/2007 | Patricelli et al. |
| 7,246,068 | B2 | 7/2007 | Thomas, Jr. |
| 7,249,076 | B1 | 7/2007 | Pendleton et al. |
| 7,275,083 | B1 | 9/2007 | Seibel et al. |
| 7,281,652 | B2 | 10/2007 | Foss |
| 7,295,988 | B1 | 11/2007 | Reeves |
| 7,298,872 | B2 | 11/2007 | Glisson |
| 7,305,359 | B2 | 12/2007 | Bonnell |
| 7,310,617 | B1 * | 12/2007 | Cunningham ..... 705/38 |
| 7,328,276 | B2 | 2/2008 | Alisuag |
| 7,330,835 | B2 | 2/2008 | Deggendorf |
| 7,333,937 | B2 | 2/2008 | Baldwin, Jr. et al. |
| 7,346,576 | B2 | 3/2008 | Lent et al. |
| 7,366,694 | B2 | 4/2008 | Lazerson |
| 7,379,913 | B2 | 5/2008 | Steele et al. |
| 7,380,707 | B1 | 6/2008 | Fredman |
| 7,383,215 | B1 | 6/2008 | Navarro et al. |
| 7,386,511 | B2 | 6/2008 | Buchanan et al. |
| 7,451,113 | B1 | 11/2008 | Kasower |
| 7,472,088 | B2 | 12/2008 | Taylor et al. |
| 7,505,939 | B2 | 3/2009 | Lent et al. |
| 7,527,967 | B2 | 5/2009 | Chao et al. |
| 7,529,698 | B2 | 5/2009 | Joao |
| 7,546,619 | B2 | 6/2009 | Anderson et al. |
| 7,556,192 | B2 | 7/2009 | Wokaty, Jr. |
| 7,571,139 | B1 | 8/2009 | Giordano et al. |
| 7,580,856 | B1 | 8/2009 | Pliha |
| 7,590,589 | B2 | 9/2009 | Hoffberg |
| 7,610,257 | B1 | 10/2009 | Abrahams |
| 7,647,274 | B2 | 1/2010 | Peterson et al. |
| 7,653,592 | B1 | 1/2010 | Flaxman |
| 7,672,865 | B2 | 3/2010 | Kumar et al. |
| 7,689,505 | B2 | 3/2010 | Kasower |
| 7,698,236 | B2 | 4/2010 | Cox et al. |
| 7,730,509 | B2 | 6/2010 | Boulet et al. |
| 7,853,493 | B2 | 12/2010 | DeBie et al. |
| 7,860,786 | B2 | 12/2010 | Blackburn et al. |
| 2001/0034618 | A1 | 10/2001 | Kessler et al. |
| 2001/0039523 | A1 | 11/2001 | Iwamoto |
| 2002/0010594 | A1 | 1/2002 | Levine |
| 2002/0023051 | A1 | 2/2002 | Kunzle et al. |
| 2002/0046099 | A1 | 4/2002 | Frengut et al. |
| 2002/0049968 | A1 | 4/2002 | Wilson et al. |
| 2002/0069122 | A1 | 6/2002 | Yun et al. |
| 2002/0072975 | A1 | 6/2002 | Steele et al. |
| 2002/0077964 | A1 | 6/2002 | Brody et al. |
| 2002/0099641 | A1 | 7/2002 | Mills et al. |
| 2002/0107849 | A1 | 8/2002 | Hickey et al. |
| 2002/0123904 | A1 | 9/2002 | Amengual et al. |
| 2002/0128960 | A1 | 9/2002 | Lambiotte et al. |
| 2002/0128962 | A1 | 9/2002 | Kasower |
| 2002/0129368 | A1 | 9/2002 | Schlack et al. |
| 2002/0133404 | A1 | 9/2002 | Pedersen |
| 2002/0147617 | A1 | 10/2002 | Schoenbaum et al. |
| 2002/0147669 | A1 | 10/2002 | Taylor et al. |
| 2002/0169747 | A1 | 11/2002 | Chapman et al. |
| 2002/0184054 | A1 | 12/2002 | Cox et al. |

2002/0188478 A1 12/2002 Breeland et al.
2002/0194120 A1 12/2002 Russell et al.
2003/0009418 A1 1/2003 Green et al.
2003/0018549 A1 1/2003 Fei et al.
2003/0028402 A1 2/2003 Ulrich et al.
2003/0033242 A1 2/2003 Lynch et al.
2003/0036926 A1 2/2003 Starkey et al.
2003/0036996 A1 2/2003 Lazerson
2003/0037054 A1 2/2003 Dutta et al.
2003/0046112 A1 3/2003 Dutta et al.
2003/0046223 A1 3/2003 Crawford et al.
2003/0050795 A1 3/2003 Baldwin, Jr. et al.
2003/0050796 A1 3/2003 Baldwin, Jr. et al.
2003/0078877 A1 4/2003 Beirne et al.
2003/0097342 A1 5/2003 Whittingtom
2003/0208412 A1 11/2003 Hillestad et al.
2003/0216965 A1 11/2003 Libman
2003/0229507 A1 12/2003 Perge
2003/0233259 A1 12/2003 Mistretta et al.
2003/0233323 A1 12/2003 Bilski et al.
2004/0044563 A1 3/2004 Stein
2004/0049473 A1 3/2004 Gower et al.
2004/0054619 A1 3/2004 Watson et al.
2004/0064402 A1 4/2004 Dreyer et al.
2004/0073456 A1 4/2004 Gottlieb et al.
2004/0078809 A1 4/2004 Drazin
2004/0107125 A1 6/2004 Guheen et al.
2004/0107161 A1 6/2004 Tanaka et al.
2004/0122730 A1 6/2004 Tucciarone et al.
2004/0122735 A1 6/2004 Meshkin
2004/0139025 A1 7/2004 Coleman
2004/0163101 A1 8/2004 Swix
2004/0177030 A1 9/2004 Shoham
2004/0177035 A1 9/2004 Silva
2004/0199584 A1 10/2004 Kirshenbaum et al.
2004/0205157 A1 10/2004 Bibelnieks et al.
2004/0215556 A1 10/2004 Merkley, Jr. et al.
2004/0236688 A1 11/2004 Bozeman
2004/0267660 A1 12/2004 Greenwood et al.
2005/0021397 A1 1/2005 Cui et al.
2005/0065874 A1 3/2005 Lefner et al.
2005/0086071 A1 4/2005 Fox, Jr. et al.
2005/0086072 A1 4/2005 Fox, Jr. et al.
2005/0086579 A1 4/2005 Leitner et al.
2005/0137912 A1 6/2005 Rao et al.
2005/0144067 A1 6/2005 Farahat et al.
2005/0187860 A1 8/2005 Peterson et al.
2005/0209880 A1 9/2005 Drelicharz et al.
2005/0209922 A1 9/2005 Hofmeister
2005/0222906 A1 10/2005 Chen
2005/0228748 A1 10/2005 Togher et al.
2005/0251820 A1 11/2005 Stefanik et al.
2005/0278743 A1 12/2005 Flickinger et al.
2005/0288954 A1 12/2005 McCarthy et al.
2006/0004731 A1 1/2006 Seibel et al.
2006/0041443 A1 2/2006 Horvath
2006/0080139 A1 4/2006 Mainzer
2006/0080233 A1 4/2006 Mendelovich et al.
2006/0080251 A1 4/2006 Fried et al.
2006/0100954 A1 5/2006 Schoen
2006/0106670 A1 5/2006 Cai et al.
2006/0111940 A1 5/2006 Johnson et al.
2006/0155639 A1 7/2006 Lynch et al.
2006/0173772 A1 8/2006 Hayes et al.
2006/0178971 A1 8/2006 Owen et al.
2006/0178983 A1 8/2006 Nice et al.
2006/0206379 A1 9/2006 Rosenberg
2006/0212353 A1 9/2006 Roslov et al.
2006/0223043 A1 10/2006 Dancy-Edwards et al.
2006/0224696 A1 10/2006 King et al.
2006/0235743 A1 10/2006 Long et al.
2006/0242039 A1 10/2006 Haggerty et al.
2006/0242046 A1 10/2006 Haggerty et al.
2006/0242049 A1 10/2006 Haggerty et al.
2006/0242050 A1 10/2006 Haggerty et al.
2006/0242051 A1 10/2006 Haggerty et al.
2006/0282359 A1 12/2006 Nobili et al.
2006/0287915 A1 12/2006 Boulet et al.
2006/0287919 A1 12/2006 Rubens et al.
2006/0293921 A1 12/2006 McCarthy et al.
2006/0293954 A1 12/2006 Anderson et al.
2006/0293955 A1 12/2006 Wilson et al.
2006/0294199 A1 12/2006 Bertholf
2007/0011020 A1 1/2007 Martin
2007/0011039 A1 1/2007 Oddo
2007/0022032 A1 1/2007 Anderson et al.
2007/0061195 A1 3/2007 Liu et al.
2007/0061243 A1 3/2007 Ramer et al.
2007/0067297 A1 3/2007 Kublickis
2007/0078835 A1 4/2007 Donnelli
2007/0112668 A1 5/2007 Celano et al.
2007/0118410 A1 5/2007 Nadai
2007/0192165 A1 8/2007 Haggerty et al.
2007/0192409 A1 8/2007 Kleinstern et al.
2007/0198336 A1 8/2007 Thompson
2007/0198407 A1 8/2007 Winter
2007/0208619 A1 9/2007 Branam et al.
2007/0226047 A1 9/2007 Ward
2007/0226130 A1 9/2007 Haggerty et al.
2007/0233857 A1 10/2007 Cheng et al.
2007/0244732 A1 10/2007 Chatterji et al.
2007/0258626 A1 11/2007 Reiner
2007/0262140 A1 11/2007 Long, Sr.
2007/0279187 A1 12/2007 Hekmatpour et al.
2007/0282684 A1 12/2007 Prosser et al.
2007/0288271 A1 12/2007 Klinkhammer
2007/0288950 A1 12/2007 Downey et al.
2007/0288953 A1 12/2007 Sheeman et al.
2007/0299699 A1 12/2007 Policelli et al.
2008/0005313 A1 1/2008 Flake et al.
2008/0010206 A1 1/2008 Coleman
2008/0015979 A1 1/2008 Bentley
2008/0028067 A1 1/2008 Berkhin et al.
2008/0059317 A1 3/2008 Chandran et al.
2008/0059352 A1 3/2008 Chandran
2008/0065569 A1* 3/2008 Dutt et al. ..... 705/404
2008/0086400 A1 4/2008 Ardelean et al.
2008/0091519 A1 4/2008 Foss
2008/0109315 A1 5/2008 Huang et al.
2008/0120133 A1 5/2008 Krishnaswami et al.
2008/0120155 A1 5/2008 Pliha
2008/0177836 A1 7/2008 Bennett
2008/0184289 A1 7/2008 Cristofalo et al.
2008/0189202 A1 8/2008 Zadoorian et al.
2008/0221972 A1 9/2008 Megdal
2008/0222027 A1 9/2008 Megdal et al.
2008/0228635 A1 9/2008 Megdal et al.
2008/0255897 A1 10/2008 Megdal et al.
2008/0270209 A1 10/2008 Mauseth et al.
2008/0270295 A1 10/2008 Lent et al.
2008/0288283 A1 11/2008 Baldwin, Jr. et al.
2008/0294501 A1 11/2008 Rennich et al.
2008/0294540 A1 11/2008 Celka et al.
2008/0301727 A1 12/2008 Cristofalo et al.
2009/0018996 A1 1/2009 Hunt et al.
2009/0024484 A1 1/2009 Walker et al.
2009/0044246 A1 2/2009 Sheehan et al.
2009/0044279 A1 2/2009 Crawford et al.
2009/0094640 A1 4/2009 Anderson et al.
2009/0133058 A1 5/2009 Kouritzin et al.
2009/0222308 A1 9/2009 Zoldi et al.
2009/0248573 A1 10/2009 Haggerty et al.
2009/0276244 A1 11/2009 Baldwin, Jr. et al.
2009/0288109 A1 11/2009 Downey et al.
2010/0023448 A1 1/2010 Eze
2010/0037255 A1 2/2010 Sheehan et al.
2010/0138290 A1 6/2010 Zschocke et al.

FOREIGN PATENT DOCUMENTS

EP 1 122 664 A2 8/2001
WO WO 94/12943 6/1994
WO WO 95/12857 5/1995
WO WO 97/23838 7/1997
WO WO 99/04350 1/1999
WO WO 99/46710 9/1999
WO WO 01/04821 1/2001
WO WO 01/41355 6/2001
WO WO 01/75754 10/2001

| | | | |
|---|---|---|---|
| WO | WO 01/84281 | | 11/2001 |
| WO | WO 02/13047 | | 2/2002 |
| WO | WO 03/101123 | A2 | 12/2003 |
| WO | WO 2004/114160 | | 12/2004 |
| WO | WO 2007/149941 | A2 | 12/2007 |
| WO | WO 2008/021061 | | 2/2008 |

OTHER PUBLICATIONS

U.S. Appl. No. 12/220,320, filed Jul. 23, 2008, Brunzell et al.
"ACS Company Birch & Davis Wins Texas CHIP Contract," PR Newswire, Section: Financial News, 3 pgs., Dallas, TX, May 17, 2000.
"An even better solution to financing elective surgery . . . ," Unicorn Financial, 7 pgs., as downloaded from http://web.archive.org/web/20000816161359/http://www.unicornfinancial.com/ [Oct. 15, 2008 3:45:25 PM].
"Atlas on Demand, Concurrent, and Everstream Strike Video-On-Demand Advertising Alliance", ATLASSOLUTIONS.COM, Jul. 13, 2006, 3 pages.
"Authorizing Safety Net Public Health Programs," Hearing before the Subcommittee on Health of the Committee on Energy and Commerce, House of Respresentatives, One Hundred Seventh Congress, First Session, Serial No. 107-57, dated Aug. 1, 2001, 226 pgs., available at http:///www.access.gpo.gov/congress/house.
"Birch & Davis Wins Texas CHIP Contract," Birch & Davis Press Release, dated Jan. 4, 2000, 3 pgs., as downloaded from http://web.archive.org/web/20010304065515/www.birchdavis.com/txchip.htm (1 of 3) [Oct. 20, 2008 9:49:18 AM].
"Epsilon Leads Discussion on Paradigm Shift in TV Advertising," EPSILON.COM, Jun. 24, 2004, 2 pages, http://www.epsilon.com/who-pr_tvad040624.html.
"Financing Medical Procedures A Lucrative But Risky Business," Credit Risk Management Report, vol. 10, Issue 15, 2 pgs., dated Aug. 7, 2000.
"Improving the Implementation of State Children's Health Insurance Programs for Adolescents Report of an Invitational Conference Sponsored by the American Academy of Pediatrics, Section on Adolescent Health," Pediatrics, Official Journal of the American Academy of Pediatrics, Invitational Conference Planning Committee and Particpating Organizations/Agencies, held Sep. 26-27, 1999, available at http://www.pediatrics.org/cgi/content/full/105/4/906.
"IRI and Acxiom Introduce More Efficient and Actionable Approach to Consumer Segmentation and Targeted Marketing," EU-MARKETINGPORTAL.DE, Jan. 26, 2006, 2 pages, http://www.eu-marketingportal.de.
"MediCredit Announces Major Investment from Medstone; Financing Will Enable Dramatic Expansion of Online Services," Business Wire, 2 pgs, dated May 12, 2000.
"Web Site Fuels Elective Surgery Trend; The Complete Resource to Paying for Cosmetic Surgery, Laser Vision Correction and Cosmetic Dentistry," Business Wire, 2 pgs, dated Apr. 7, 1999.
"Accenture Completes Acquisition of Media Audits: Acquisition Expands Company's Marketing Science and Data Services Capabilities," ACCENTURE.COM, Dec. 12, 2005, 2 pages, http://accenture.tekgroup.com/article_display.cfm?article_id=4282.
"Accenture Launches Media Audit and Optimization Service to Help U.S. Companies Measure Return on Investment in Advertising," Business Wire, May 22, 2006, 2 pages, http://findarticles.com/p/articles/mi_m0EIN/is_2006_May_22/ai_n16374159.
"Arbitron 2006 Black Consumers," Arbitron Inc., LVTSG.COM, Jul. 8, 2006, 2 pages, http://www.lvtsg.com/news/publish/Factoids/article_3648.shtml.
"Atlas on Demand and C-COR Join Forces to Offer Advertising Management Solution for on Demand TV: Global Provider of On Demand Systems Parters with Atlas to Develop and Market Comprehensive VOD Advertising Solution," ATLASSOLUTIONS.COM, Jul. 25, 2005, 3 pages.
Atlas on Demand and Tandberg Television Join Forces to Enhance Dynamic Ad Placement for On-Demand Television: Combined End-to End Solution to Provide Media Buying and Selling Communities with New Tools for Dynamic Advertising that Eliminate Technical Bar Jun. 22, 2006—3 pages, http://www.atlassolutions.com/news_20060622.aspx.
"Cable Solution Now, The Industry Standard for Information Management: Strata's TIM.net Crosses Important Threshold Dominant Solution for All Top 20 TV Markets," STRATAG.COM, Apr. 28, 2006, 1 page, http://stratag.com/news/cablepress042806.html.
"Claritas Forms Life Insurance Consortium with Worldwide Financial Services Association: Initiative with LIMRA International is First of its Kind to Provide Acutal Sales Information at Small Geographic Areas," CLARITAS.COM, Feb. 9, 2006, 3 pages, http.
"Claritas Introduces PRIZM NE Consumer Electronic Monitor Profiles: New Information Product Provides Insight Into The Public's Purchasing Behaviors of Comsumer Electronics," CLARITAS.COM May 30, 2006, 3 pages.
Information Resources, Inc. and Navic Networks Form Joint Relationship to Support Next Generation of Technology for Advertising Testing, IRI Expands BehaviorScan® Solution to Meet Digital and On-demand Needs, INFORES.COM, Feb. 27, 2006, 2 pages, http://us.infores.com/page/news/pr/prearchive?mode=single&pr_id=117.
"Mediamark Research Inc. Releases Findings From Mobile Marketing Consumer Study; Outback Steakehouse and Royal Caribbean Cruise Lines Among Brands Participating in Moble Marketing Research," THEFREELIBRARY.COM, May 9, 2006, 4 pages, http://thefreelibrary.com.
"SRC Announces Free Dashups to Mashups Adding Geographic Business Intelligence at Web Speed to the Enterprise on www.FreeDemographics.com/API," DIRECTIONSMAG.COM, Jun. 12, 2006, 3 pages, http://www.directionsmag.com/press.release/index.php?duty=Show&id=14532&trv=1.
"SRC Delivers Industry's First Drive Time Engine Developed to Follow Actual Road Networks," THOMASNET.COM, May 21, 2006, 4 pages, http://news.thomasnet.com/companystory/485722.
"VOD Integration Now Available In Strata: Buyers / Sellers Benefit from VOD Component on Popular Platform," STRATAG.COM, Feb. 21, 2006, 1 page, http://www.stratag.com/news/mediapress022106.html.
Adweek, "Aim High: Ad Targeting Moves to the Next Level," dated Jan. 21, 2008 as downloaded from http://www.adweek.com/aw/magazine/article_display.isp?vnu on Apr. 16, 2008.
adzilla, Press Release, "ZILLACASTING technology approved and patent pending," dated May 16, 2005 as downloaded from http://www.adzilla.com/newsroom/pdf/patent_051605.pdf on May 28, 2008.
AFX New Limited—AFX International Focus, "Nielsen moving to measure off-TV viewing," Jun. 14, 2006, 1 page.
An Expert System for Determining Medicaid Eligibility, Journal of Medical Systems, vol. 12, Nov. 5, 1988, in 10 pages.
Andrew Reinbach, MCIF aids banks in CRA compliance, Bank Systems & Technology, vol. 32, No. 8, pp. 27, Aug. 1995.
Bachman, Katy, "Arbitron, VNU Launch Apollo Project," MEDIAWEEK.COM Jan. 17, 2006, 3 pages, http://www.mediaweek.com/mw/search/article_display.jsp?schema=&vnu_content_id=1001847353.
State of Wisconsin, Division of Health Care Financing, Department of Health and Family Services: 1999-2001 Biennial Report, pp. 17-21.
Barry, Ellen, "Life, Liberty, and the Pursuit of Lipo," The Boston Phoenix, News & Opinion, dated Apr. 6, 1998, as downloaded at http://weeklywire.com/ww/04-06-98/boston_feature_1.html (1 of 12) [Oct. 15, 2008 2:35:25 PM].
Belford, Terrence, "Technology Quarterly: Computers Internet speeds credit checks System tailored for doctors, dentists," The Globe and Mail (Canada), Section: Report on Business Special Reports, dated Mar. 18, 1997, 2 pgs.
Boss, Shira J. "Elective Surgery Without the Plastic: Low-Interest Medical Financing Provides Alternative to Credit Cards," factiva, Crain's New York Business, 2 pgs., dated Jun. 22, 1998.
Broward County CAP Grant Application, 41 pgs., as printed on Aug. 10, 2009.
Burr Ph.D., et al., Utility Payments as Alternative Credit Data: A Reality Check, Asset Builders of America, Inc., Dec. 15, 2006, pp. 1-18, Washington, D.C.
Calnan, Christopher, "Tenet, Fair Isaac invest $20M in startup," MHT, Mass High Tech: The Journal of New England Technology, dated Jul. 23, 2007, 2 pgs.

Capps, Randy et al., "Recent Changes in Texas Welfare and Work, Child Care and Child Welfare Systems," Assessing the New Federalism, The Urbane Institute, State Update No. 1, 24 pgs., Jun. 2001.
CAPStone Newsletter, Sep. 2001, 8 pgs., as downloaded from http://web.archive.org/web/20011213115738/www.capcommunity.hrsa.gov/Newsletter/Newsletter12.htm (1 of 8) [Oct. 18, 2008 2:39:47 PM].
Card Marketing, Use the Latest CRM Tools and Techniques, www.CardForum.com, vol. 5 No. 10, Dec. 2001.
Cheney, Karen, "Fix Your Nose, If You Wish, But Not With This New Loan," Money Magazine, vol. 27, No. 5, 1 pg., dated May 1, 1998.
Click Z, "ISPs Collect User Data for Behavioral Ad Targeting," dated Jan. 3, 2008 as downloaded from http://www.clickz.com/showPage.html?page=clickz on Apr. 16, 2008.
CNET NEWS.COM, "Target me with your ads, please," dated Dec. 5, 2007 as downloaded from http://www.news.com/2102-1024_3-6221241.html?tag+st.util.print on Mar. 18, 2008.
Creamer, Matthew, "Consulting in marketing; Accenture, others playing role in firms' processes," Crain's Chicago Business, Jun. 12, 2006, 2 pages, Crain Communications.
Experian, "Custom Strategist and Qualifile from Funds", 2000, 2 pages.
Delany, Kevin J., et al. Firm Mines Offline Data to Target Online Ads; Commercial Alert Oct. 17, 2007; as downloaded from http://www.commercialalert.org on Apr. 22, 2008.
DEMOGRAPHICSNOW.COM, sample reports, "Age Rank Report", Jul. 17, 2006, 3 pages.
DEMOGRAPHICSNOW.COM, sample reports, "Consumer Expenditure Summary Report", Jul. 17, 2006, 3 pages.
DEMOGRAPHICSNOW.COM, sample reports, "Income Comparison Report", Jul. 17, 2006, 4 pages.
DentalFinancing.com, "Financial services for patients and dental professionals,", 7 pgs., as downloaded from http://web.archive.org/web/20010607151954/www.dentalfinancing.com/dentist/index.asp (1 of 2) ]Oct. 15, 2008 3:55:16 PM].
Dietz, Ellen, "Dental Office Management," 8 pgs., pp. 316-321, Copyright 2000.
eFunds Introduces QualiFile$^{SM}$; Deluxe Corporation; Sep. 1999; Milwaukee, WI.
Electronic Privacy Information Center, "The Fair Credit Reporting Act" 15 USC 1681 (1992), 10 pgs., as downloaded from http://epic.org/privacy/financial/fcra.html on Mar. 19, 2008.
Ellwood, Marilyn, "The Medicaid Eligibility Maze: Coverage Expands, but Enrollment Problems Persist, Findings from a Five-State Study," Mathematica Policy Research, Inc., Occasional Paper No. 30, 56 pgs., Dec. 1999.
Ettore, Paul Kahn on Exceptional Marketing. Management Review, vol. 38(11), Nov. 1994, pp. 48-51.
Felsenthal, Edward, "Health Costs; Managed Care Helps Curb Costs, Study Says," The Wall Street Journal, dated Aug. 12, 1991.
Front Porch Brochure, "Ad Networks—Partner with Front Porch!: Our Internet-Wide Behavioral Targeting Brings Ad Networks Higher Revenue", 2 pages (Publication date unknown, copyright date is 2008).
Front Porch Brochure, "New Free Revenue for Broadband ISPs!: Get your share of the $20 billion online advertising market!", 2 pages (Publication date is unknown, copyright date is 2008).
Gilje, Shelby, "Credit Agency Moving Into Health Care," NewsRoom, Seattle Times, WA, Section: Scene, Dated Mar. 22, 1995, 3 pgs., as downloaded from http://web2.westlaw.com/result/documenttext.aspx?rs=WLW8.03&ss+CNT&rp=%2fWelc . . . on Mar. 19, 2008.
Goldstein, Jacob, "The Newest Vital Sign: Your Credit Score," The Wall Street Journal, Health Blog, as viewed at http://blogs.wsj.com/health/2008/03/18/the-newest-vital-sign-your-cr . . . , 3 pgs.
Halliday, Jean, "Ford recruits Accenture for marketing plan," Automotive News Feb. 13, 2006, 2 pages, Crain Communications.
Helm, Burt, "Nielsen's New Ratings Yardstick," BUSINESSWEEK.COM, Jun. 20, 2006, 3 pages, http://www.businessweek.com/technology/content/jun2006/tc20060620_054223.htm.
Henry, M.D., Kimberly A., "The Face-Lift Sourcebook," copyright 2000, 3 pgs. (p. 207).
Hinman, Donald P., "The Perfect Storm: Response Metrics and Digital TV," CHIEFMARKERTER.COM, May 17, 2006, 2 pages, http://www.chiefmarketer.com/crm_loop/roi/perfect-storm-051706/index.html.
Ideon, Credit-Card Registry that Bellyflopped this Year, Is Drawing some Bottom-Fishers, The Wall Street Journal, Aug. 21, 1995, pp. C2.
IndiCare™, On-Line Patient Assistant Program, Website Users Manual; JBI Associates, LLC; 1997.
International Search Report and Written Opinion for PCT/US 08/83939, filed on Nov. 18, 2008, in 12 pages.
International Search Report and Written Opinion in PCT Application No. PCT/US2007/21815; Dated Sep. 5, 2008 in 11 pages.
Kent, Heather, "Huge declines in price as competition heats up in Vancouver's booming laser-surgery market," CMAJ, Oct. 5, 1999; 161 (7), pp. 857-858.
Lavelle, Marianne, "Health Plan Debate Turning to Privacy Some Call for Safeguards on Medical Disclosure. Is a Federal Law Necessary?," The National Law Journal, vol. 16, No. 39, dated May 30, 1994, as downloaded from http://web2.westlaw.com/result/documenttext.aspx?rs=WLW8.03&ss=CNT&rp=%2fWelc . . . on Mar. 19, 2008.
Magid, Lawrence, J. , Business Tools: When Selecting an ASP Ensure Data Mobility, Los Angeles Times, Feb. 26, 2001, vol. C, Issue 4, pp. 3 pages, Los Angeles, CA.
Mathematica Policy Research, Inc., "1998 Health Care Survey of DoD Beneficiaries: Technical Manual," Jul. 1999.
McGovern, Celeste, Jayhawk Medical Acceptance. (Brief Article), Alberta Report, 1 pg., dated Aug. 23, 1999.
McLaughlin, Nancy H., NewsRoom, Greensboro News & Record (NC), Section: General News, "Homeless, Pregnant and Alone Dana Sides Knows Her Baby Is Likely to Come in a Month, But She Has No Idea Where She Will Go After Leaving the Hospital," dated Dec. 6, 2001.
MediCredit, Patient Financing, "Thought you couldn't afford Cosmetic Surgery'?," 3 pgs., as downloaded from http://web.archive.org/web/19970601060333/http://www.medicredit.com/ (1 of 2) [Oct. 15, 2008 3:16:31 PM].
NebuAD, Wall Street Journal Online, "Venture Capital: What's New", Oct. 22, 2007, 2 pages, http://www.nebuad.com/company/media_coverage/media_10_22_07.php.
NewsRoom, Insurance Regulator, State Survey, "CIGNA Report Withdrawn As Foe Sees Opening," Sep. 9, 1966, vol. 8, Issue 34, 4pgs, as downloaded at http://web2.westlaw.com/result/documenttext.aspx?rs=WLW8.03&ss=CNT&rp=%2fWelc . . . on Mar. 19, 2008.
Pennsylvania Law Weekly, "Discriminating Against Victims Admitting Domestic Abuse Can Lead to Denial of Insurance Coverage," vol. XVIII, No. 26, dated Jun. 26, 1996, 2 pgs., as downloaded from http://web2.westlaw.com/result/documenttext.aspx?rs=WLW8.03&ss=CNT&rp=%2fWelc . . . on Mar. 19, 2008.
Phorm, "The Open Internet Exchange", 2 pages, http://www.phorm.com/oix (Publication date unknown, copyright date 2008).
Phorm, Press Release Regarding Exclusive Agreements, 2 pages, Feb. 14, 2008, http://www.phorm.com/about/launch_agreement.php.
Predictive Behavioral Targeting as downloaded from http://www.predictive-behavioral-targeting.com/index.php.Main_Page on Mar. 28, 2008.
RAP Interactive, Inc. and Web Decisions: Proudly Presents Live Decisions, A Powerful New Information and Technology Resource that Revolutionizes Interactive Marketing, downloaded from www.webdecisions.com/pdf/LiveDecision_Bro.pdf, 2 pgs., as printed on Aug. 13, 2007.
Rubin, Rita, "Cosmetic Surgery on Credit Finance plans let patients reconstruct now, pay later," The Dallas Morning News, 2 pgs., dated Sep. 10, 1988.
SearchAmerica, Solutions, "Payment Advisor Suite TM" 2008.
Selz, Michael, "Lenders Find Niche in Cosmetic Surgery That Isn't Insured—But Since You Can't Repossess A Nose Job, Risks Aren't Restricted to the Patients," Wall Street Journal, New York, N.Y., Jan.

1997, p. A1, 3 pgs., as downloaded from http://proquest.umi.com.libproxy.mit.edu/pqdweb?index=0&sid=1srchmode=1&vinst=. . . Oct. 14, 2008.
Stein, Benchmarking Default Prediction Models: Pitfalls and Remedies in Model Validation, Moody's KMV, Revised Jun. 13, 2002, Technical Report #020305; New York.
Texas Department of Human Services, 1999 Annual Report, 60 Years of Progress, Medial Services 9P137, Publication No. DHS-600-FY99.
thatlook.com, Costmetic Surgery Financing, 3 pgs, as downloaded from http://web.archive.org/web/200001214113900/www.thatlook.com/cosmetic_surger_financing.cfm (1 of 2) [Oct. 15, 2008 4:11:47 PM].
Thomas, David, "Report on Networks and Electric Communications Newcourt Credit turns to extranet Services / A PC connects to 1,200 users at once." The Globe and Mail (Canada), Section: Report on Business Special Report, 2 pgs., dated Nov. 12, 1996.
UPI, "Nielsen Media Research goes electronic," Jun. 14, 2006, 1 page.
Washington State Office of Public Defense, "Criteria and Standards for Determining and Verifying Indigency," dated Feb. 9, 2001.
Webpage printed from <http://www.magnum.net/pdfs/RapUpBrochure.pdf.> on Mar. 4, 2008.
Whitney, Daisy, "Atlas Positioning to Shoulder VOD Ads; Campaign Management Tools Optimize Inventory," TelevisionWeek, May 23, 2005, 3 pages.
Window on State Government, Susan Combs, Texas Comptroller of Public Accounts, Chapter 8: Health and Human Services, "Improve the Medicaid Eligibility Determination Process," 9 pgs., as downloaded at http://www.window.state.tx.us/etexas2001/recommend/ch08/hhs08.html on Apr. 9, 2008.
Wisconsin Department of Workforce Development, BadgerCare Medicaid Application Credit Report Authorization Form, dated Jun. 21, 2001.
Wisconsin Department of Workforce Development, BadgerCare Medicaid Notification of Eligibility, dated Jul. 25, 2000.
Zoot—Decision Engine, <www.zootweb.com/decision_engine.html>, as printed Mar. 3, 2008.
Zoot—Instant Rules GUI, <www.zootweb.com/instant_rules_GUI.html> as printed Mar. 3, 2008.
Zoot—Pre-Built Standard Attributes, <www.zootweb.com/credit_attributes.html> as printed Mar. 3, 2008.
Zoot—Rules Management GUI, <www.zoot.web.com/rules_management_GUI.html> as printed Mar. 3, 2008.

* cited by examiner

Ryan, you are Pre-Qualified for The Quanta Platinum Card

- Earn Rewards Faster Than Any Other Card. With LightSpeed℠ rewards, there is virtually no limit to your earning power!
- **Lower Fees Courtesy of the *Planck Constant*®.** We guarantee that your fees will always be proportional to your spending.
- A Bank You Can Trust. Planck Financial has been serving customers like you since 1899.

View detailed terms & conditions

With Planck Financial, probability is on your side!

Overview - Lorem ipsum dolor sit amet, consectetur adipisicing elit, sed do eiusmod tempor incididunt ut labore et dolore magna aliqua. Ut enim ad minim veniam, quis nostrud exercitation ullamco laboris nisi ut aliquip ex ea commodo consequat. Duis aute irure dolor in reprehenderit in voluptate velit esse cillum dolore eu fugiat nulla pariatur. Excepteur sint occaecat cupidatat non proident, sunt in culpa qui officia deserunt mollit anim id est laborum.

*You can choose to stop receiving "prescreened" offers of credit by calling toll-free 1.888.555.1337. For more information about prescreened offers, please see the PRESCREEN & OPT-OUT NOTICE in the terms, conditions, and disclosures linked to this application.*

| Intro Rate | APR | Grace Period | Annual Fee | Credit Limit |
|---|---|---|---|---|
| 0% for 15 months | 10.99% to 18.99% | At least 25 days | $0 | Up to $5,000 |

Click Here to Sign Up Now!

<< Back to All Offers

Fig. 13

CREDIT CARD MATCHING

CROSS-REFERENCE TO RELATED APPLICATIONS

This application claims priority to U.S. Provisional Application No. 61/103,528, filed Oct. 7, 2008, which is hereby incorporated by reference in its entirety.

BACKGROUND

1. Field of the Disclosure

This disclosure relates to systems and methods for providing credit card referrals to consumers.

2. Description of the Related Art

Credit card issuers typically offer a finder's fee, also referred to as a "bounty," to entities that refer consumers to the credit card issuer after the consumer applies and is accepted for a particular credit card. Accordingly, third parties have an incentive to refer qualified consumers to credit card issuers in order to receive bounties from those credit card issuers.

SUMMARY

The systems, methods, and devices of the invention each have several aspects, no single one of which is solely responsible for its desirable attributes. Without limiting the scope of the invention, certain features will now be discussed briefly.

In one embodiment, a computerized method for providing credit card offers to a consumer comprises receiving consumer identification information associated with a consumer from an interface, storing the consumer identification information in a computer readable medium, retrieving a credit score associated with the consumer in response to receiving a consumer request to match the consumer to one or more credit cards, storing the credit score in a computer readable medium, and determining one or more prequalified credit card offers for the consumer for one or more credit cards based on the credit score being within acceptable credit score ranges associated with the respective one or more credit cards. The method further comprises in response to determining that the credit score is within an acceptable credit score range for a threshold quantity of credit cards, performing without notifying the consumer: initiating transmission of a request for a prescreening of the consumer to a prescreening device, wherein the request includes at least some of the consumer identification information received from the consumer as part of the consumer's request to match the consumer to one or more credit cards, and receiving indications of any prescreened credit card offers for the consumer from the prescreening device, and generating a user interface indicating the prequalified credit card offers and the prescreened credit card offers for transmission to a computing device associated with the consumer, wherein the prescreened credit card offers comprise a firm offer of credit to the consumer and the prequalified credit card offers do not comprise a firm offer of credit to the consumer.

In one embodiment, a system for providing credit cards offers to a consumer comprises a processor, a computer readable memory storing acceptable credit score ranges associated with respective one or more credit cards, an interface module configured to receive authorization to retrieve a credit score associated with a consumer to match the consumer to the one or more credit cards, and a card match module configured to retrieve the credit score associated with the consumer, match one or more prequalified credit card offers to the consumer based on the credit score being within the acceptable credit score ranges associated with the respective one or more credit cards, initiate transmission of a request to match the consumer to or more prescreened credit card offers to a prescreening device; and receive indications of any matched prescreened credit card offers for the consumer from the prescreening device.

In one embodiment, a computer readable medium stores software instructions that are readable by a computing system, wherein the software code is executable on the computing system in order to cause the computing system to perform a method comprising receiving consumer identification information associated with a consumer from an interface, initiating transmission of a request for a credit score associated with the consumer in response to receiving a request to match the consumer to one or more credit cards, associating the consumer with one or more tiers based on the credit score, wherein each tier is associated with zero or more prequalified credit card offers. The method further comprises in response to associating the consumer with a tier associated with a threshold number of prequalified credit card offers, initiating transmission of a request for a prescreening of the credit information associated with the consumer to a prescreening device, and receiving one or more indications of any prescreened credit card offers for the consumer, and initiating display of indications prequalified credit card offers and prescreened credit card offers on a computing device associated with the consumer.

BRIEF DESCRIPTION OF THE DRAWINGS

FIG. 13 is a sample screen shot illustrating one embodiment of a user interface that displays more information regarding certain of the displayed credit cards that may be provided to the consumer.

DETAILED DESCRIPTION

Embodiments of the invention will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1A:
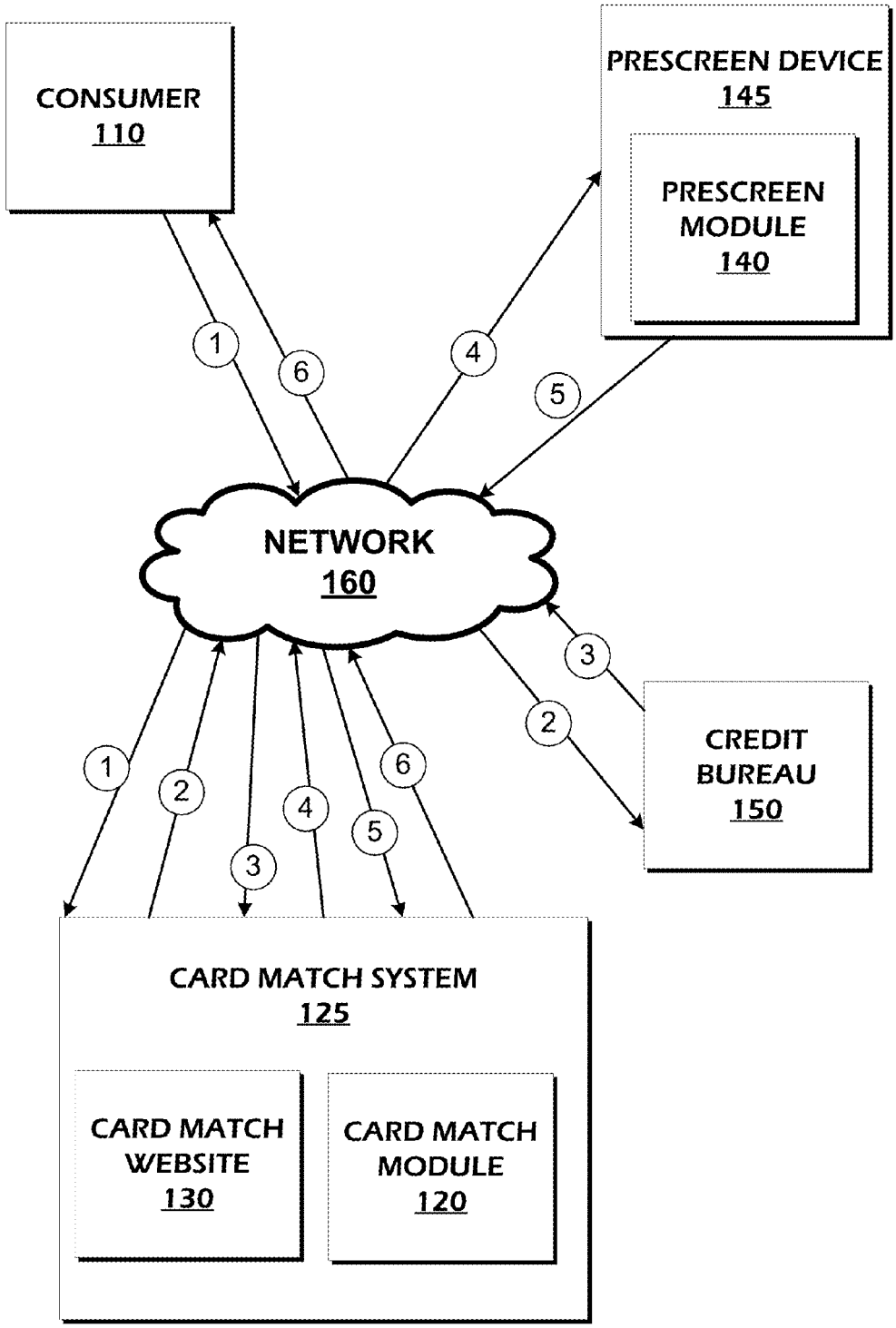
FIG. 1A is a block diagram illustrating one embodiment of a card match system in communication with a consumer, a prescreen device, and a credit bureau via a network.

FIG. 1A is a block diagram illustrating one embodiment of a card match system 125 in communication with a consumer computing device 110 (also referred to herein as "consumer 110"), a prescreen device 145, and/or a credit bureau 150 via a network 160. Depending on the embodiment, the network 160 may comprise one or more of any available network, such as a local area network, wide area network, or personal area network, and/or the Internet. The network 160 may comprise one or more wired or wireless communication links and may include secure or unsecured communication links.

In the embodiment of FIG. 1A, the card match system 125 comprises a card match module 120 that coordinates matching of credit cards to consumers from both a prequalification credit card matching process and a prescreen credit card matching process. The card match system 125 may include a commercial business or a nonprofit organization. Depending on the embodiment, the card match system 125 may be operated and controlled by a credit bureau, an agent of the credit bureau, or any other party.

Credit cards may be matched to a consumer using one or both of prequalification process (also referred to as a "prequal" process) and/or a prescreen (also referred to as "preapproval" process), which each have advantages over the other process. In particular, the prequalification process is a consumer initiated process that requires authorization from the consumer before the prequalification matching process is performed. Thus, the consumer must opt-in to the prequalification process in order to receive indications of matching cards. In contrast, the prescreen process must be performed (due to regulatory constraints) without the consumer knowing that the process is being performed. Thus, the entity that requests the prescreening for a given consumer cannot ask the consumer for major identification information (e.g., name, address, Social Security number, etc.) solely for the purpose of performing prescreening on the consumer. Thus, prescreening may be used by commercial websites, for example, after an order entry page has been completed by a consumer and the website provider already has the consumer identification information.

Each of the prequalification and prescreen credit card matching processes may post credit inquiry notices to the consumers credit file. Depending on the embodiment, the credit inquiry notice for the prequalification process may result in a soft pull being logged to the consumer's credit file, which may not affect (or minimally affects) the credit score of the consumer. Alternatively, the credit inquiry notice for the prequalification process may result in a hard pull being logged to the consumer's credit file, which may more significantly affect the credit score of the consumer. Similarly, the prescreen matching process may log a soft pull to the consumer's credit file in one embodiment, while in another part of the prescreen matching process may log a hard pull to the consumer's credit file. As described in detail below, a new method of providing consumers with prescreened credit card offers includes performing a prescreening process after receiving identification information from a consumer as part of a prequalification process.

In the embodiment of FIG. 1, the card match module 120 determines (and sometimes provides indications of) credit cards for which respective consumers might be accepted. The card match system 125 and/or the card match module 120 may receive and/or access data from one or more credit card issuers in order to determine any credit cards that "match" the consumer. The card match module 120 may perform and/or request one or more of a prequalification and prescreen process for a consumer. In some embodiments, the card match system 125 and/or the card match module 120 receives input from other entities, such as from a credit bureau 150, credit card issuers, and/or other entities that provide consumer-related data.

As explained above, the terms "prequalification" and/or "prequal" include a process that requires a consumer 110 to authorize a credit pull so that the requesting entity (e.g., a card match system 125) may match any quantity of credit cards that correspond to a credit score, for example, associated with the consumer 110. In one embodiment, the prequalification matching is performed by comparing the credit score of the consumer to a set of predetermine ranges of acceptable credit scores associated with respective credit cards. The set of predetermined ranges may be determined by the card match system 125, such as in response to analyzing criteria for various credit card offers and/or previous known acceptances for respective credit cards. The credit score may indicate the credit worthiness of a consumer and/or the likelihood that a consumer will pay his/her debts. The credit score may include a score generated by one or more credit bureau, such as Experian, Equifax, or TransUnion.

In one embodiment, the card match system 125 considers only the credit score (and possibly rewards and other general card options) in determining prequal offers. The consumer 110 may then apply for the credit cards for which they have been prequalified, with an overall about 10-30% likelihood that the consumer's application for a prequalified credit card would be accepted by the credit card issuer in response to the consumer completing a full application. Thus, the entity that provides prequalified card matches to consumers may expect to receive a bounty for about 10%-30% of the consumers that actually apply for prequalified offers that are provided by the card march system 125. The terms "prequalified offer" and "prequalified credit card" refer to a credit card for which a particular consumer 110 is prequalified, using the above-described prequalification process. An entire credit report of the consumer may be returned with a response to a request for a prequalification process.

As explained above, the terms "prescreen" and/or "pre-approve" include a process that is performed without the consumer 110 providing authorization for an access of their credit score and/or other credit information or without the consumer 110 knowing that their credit is being accessed. For example, when a consumer 110 is finalizing a purchase from an online retailer, the retailer may request a prescreen of the consumer 110 without the consumer's authorization. The prescreen request is sent to a prescreen device 145 (e.g., a credit bureau or affiliate thereof), which accesses the consumer's credit file and matches the consumer 110 to zero or more credit cards based on multiple criteria that are set by the credit card issuers themselves. In some embodiments, the prescreen device 145 may only reply with an approval or a non-response. For example, a request for prescreen credit card offers for a first consumer may result in a response from the prescreen device 145 indicating that the consumer matches a particular credit card (e.g., the consumer's credit information matches the criteria provided by the issuer of the particular credit card), or that the consumer matches more than one respective credit card where the indications of matching credit cards do not include credit information for the consumer, but simply an indication that the consumer has been prescreened for the indicated credit cards. Alternatively, prescreen results may include limited credit information (e.g., score, product offers, credit lines, attributes), but not the entire credit file. If a consumer does not match any credit cards in the prescreen process, the prescreen device 145 may transmit a simple indication that the consumer does not match any credit cards, without transmitting any credit information associated with the consumer. Alternatively, a prescreen device 145 may return no result to the requesting entity if the consumer does not match any credit cards.

Because prescreened credit card offers are based on qualification inform from credit card issuers, prescreened offers can average up to about 80%-90% acceptance rate (in response to consumer completing a full application). Thus, a business may desire to provide prescreened credit card matches to consumers, rather than just prequalified credit card matches, in order to increase the quantity of consumers that are accepted for the matched credit card offers and, correspondingly, increase the bounty amounts paid to the business.

In one embodiment, the prescreen process may be legally required to be performed by a different entity than the entity that is presenting the prescreen offers to the consumers, such as the card match system 125. For example, the card match system 125 may not be allowed to have access to the criteria set by the credit card issuers. The terms "prescreened offer," "prescreened credit card," "pre-approved offer," and "pre-approved credit card" refer to a credit card that matches a particular consumer using the above-described prescreen process.

In the embodiment of FIG. 1A, the card match system 125 further comprises a card match website 130, which includes one or more user interfaces for receiving consumer identification information and for providing the consumer 110 with matched credit cards. The card match module 120 and the card match website 130 may be maintained on a common server (or server farm) or may be maintained remote to one another. The card match website 130 may be configured to interact with the consumer 110 electronically and/or through customer service representatives associated with the card match system 125. The card match website 130 may receive and store consumer identification information from a consumer. Depending on the embodiment, the consumer identification information may comprise one or more of a name, address, phone number, social security number, maiden name, signature, email address, password, secret question and answer, credit card number(s), debit card number(s), identification number(s), and/or any other identifying information.

The prescreen device 145 includes a prescreen module 140 that performs the prescreen process that matches the consumer 110 to zero or more credit cards based on credit data associated with the consumer and qualification data received from one or more credit card issuers for each of a plurality of credit cards. The credit bureau 150 comprises any available credit data provider, such as Experian, Equifax, and/or Trans Union, for example.

Figure 1B:
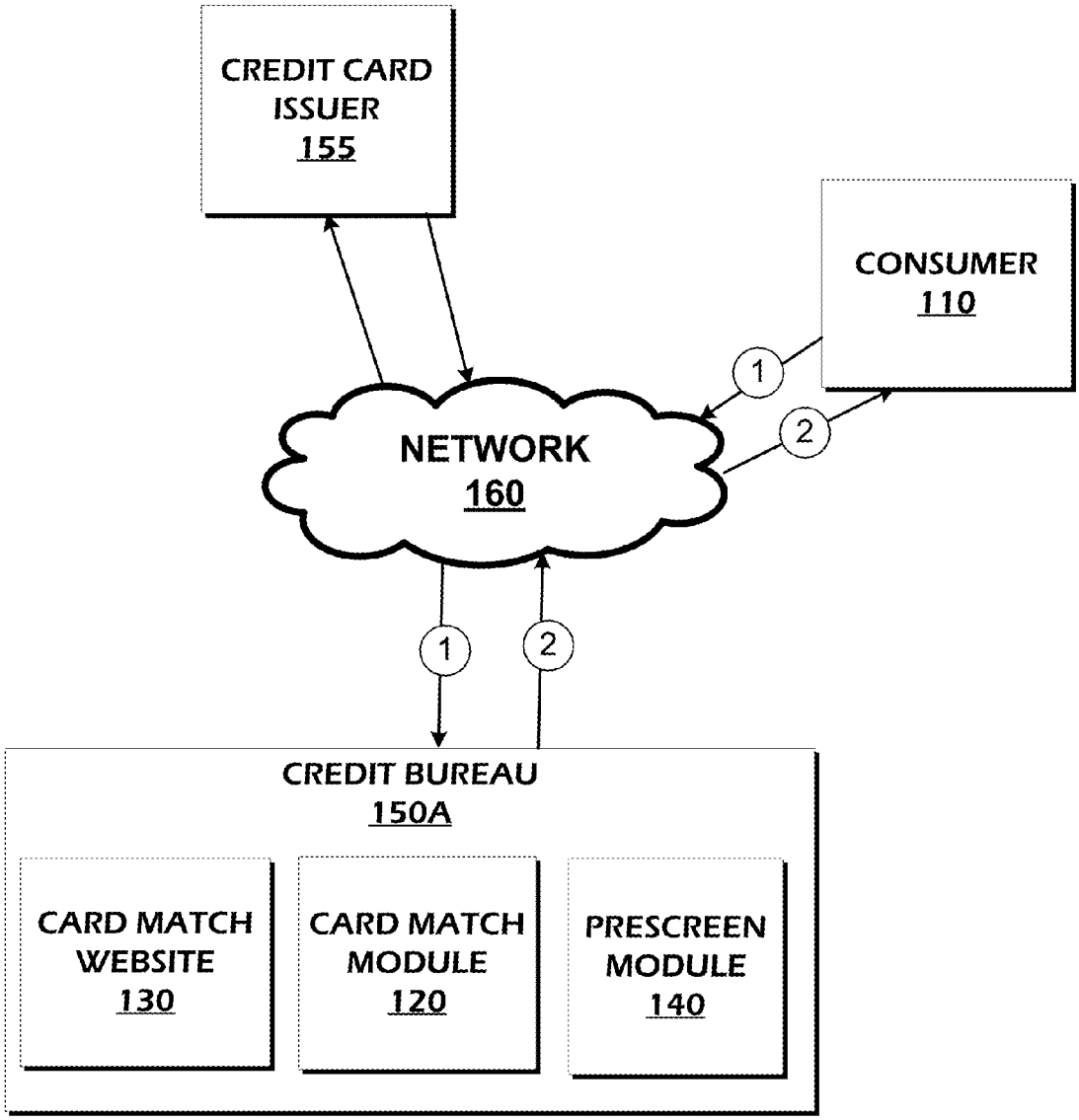
FIG. 1B is a block diagram illustrating one embodiment of a credit bureau that comprises a card match website, a card match module, and a prescreen module.

FIG. 1B is a block diagram illustrating one embodiment of a credit bureau 150A that comprises the card match website 130, the card match module 120, and the prescreen module 140. In this embodiment, the credit bureau 150, or affiliates thereof, provides the card match website 130 for interactions with the consumer 110 and controls the operations of the card match module 120 and the prescreen module 140.

FIGS. 1A and 1B illustrate embodiments of a sample temporal flow of data that is indicated by the circled numerals and is described in further detail below. Depending on the embodiment, certain stages may be removed and/or added, and the order of the stages may be changed. In one embodiment, in stage one the card match website 130 receives consumer identification information and an authorization to perform a prequalification process for one or more credit cards from the consumer 110 via one or more interfaces provided to the consumer by the card match website 130. In stage two, the card match module 120 requests credit information, such as the credit score, of the consumer from the credit bureau 150. In stage three, the credit bureau 150 returns the requested consumer credit information, if any is found. The card match module 120 then performs a prequalification process in order to determine if the consumer is prequalified for any of a number of credit cards. In one embodiment, the credit score in the returned credit information is compared to respective ranges of credit scores for each of a plurality of credit cards in order to determine any matching prequalified credit cards for the consumer. The card match system may determine the respective ranges of credit scores for one or more of the plurality of credit cards. In other embodiments, the prequalification process may comprise analysis of additional attributes of the consumer credit information.

In one embodiment, the results of the pre-qualification process dictate whether or not any prescreen matching is requested (or performed by the card match system 125). For example, in one embodiment if the prequalification process results in less than a predetermined quantity of prequalified matches, a prescreen matching is not performed for the consumer. Depending on the embodiment, the cost of performing the prescreen process may be greater than the cost of performing the prequalification process. For example, the cost of performing the prescreen process may be a multiple of 5-10 times (or any other multiple) more expensive than the cost of performing the prequalification process. Thus, if a consumer is not likely to receive any preapproved offers in response to a prescreening process, the card match system 125 may be inclined to reduce costs by not requesting a prescreen on the particular consumer. Alternatively, if the consumer is likely to receive preapproved offers in response to a prescreening process (such as might be implied if the consumer matches at least a predetermined quantity of credit cards in the prequalification process), the card match system 125 may be inclined to request a prescreen on the particular consumer in order to enhance a likelihood that the consumer would be accepted for a credit card in view of the more precise matches located by the prescreening process, and to accordingly increase the likelihood of a bounty being paid to the requesting entity.

As noted above, in one embodiment if the card match module 120 identifies a predetermined minimum quantity of prequalified offers, in stage four the card match module 120 transmits a prescreen request to the prescreen device 145 without providing a notification to the consumer 110 or receiving authorization from the consumer 110 to transmit the prescreen request. The predetermined minimum quantity of prequalified offers may be 1, 2, 3, or any other quantity, as may be determined by the card match system 125. Accordingly, if the card match module 120 does not identify the predetermined minimum quantity of prequalified offers for the consumer, the prescreen request may not be transmitted.

The prescreen module 140 on the prescreen device 145 performs a prescreen process on the consumer, which involves requesting the credit file of the consumer, for example from one or more credit bureaus 150, and comparing attributes of the consumer's credit file with requirement attributes received from respective credit card issuers. The prescreen offers, if any, are returned to the card match system 125 in stage five. In stage six, the card match system 125 then indicates the prescreen offers and/or the prequalified offers to the consumer, for example via the card match website 130. In one embodiment, the prescreen offers each comprise a firm offer of credit to the consumer, while the prequal offers do not comprise a firm offer of credit. Also, the consumer may optionally be provided with one or more invitations to apply (ITAs) for credit cards via the card match website 130, where the ITAs have a lower acceptance likelihood than even prequalified offers. In one embodiment, ITAs are presented to the consumer when no prequalified offers (and thus, no prescreened offers) are located.

In FIG. 1B, the process is similar to that of FIG. 1A, but the credit bureau 150A comprises the card match website 130, the card match module 120 and the prescreen module 140. In stage one, the consumer 110 provides consumer identification information to the credit bureau 150A via the card match website 130. In particular, the consumer 110 provides authorization for the card match module 120 to access the consumer's credit file in order to perform a prequalification process to provide the consumer with information regarding credit cards suitable for the consumer. In stage two, after performing a prequalification process and (possibly) a prescreen process for the consumer, the resulting prequal and/or prescreen credit card matches for the consumer are presented to the consumer 110 via the card match website 130. The credit bureau 150A may receive the credit card match criteria for the prescreen process from the credit card issuer 155, which may increase the likelihood that a matched consumer will be approved for a matched credit card if the consumer applies for the matched credit card.

In one embodiment, the card matching process (including the prequalification and prescreen processes) occurs in substantially real-time. For example, the card matching process (e.g., from the time the request is transmitted from the consumer until the card match system returns any matched prequal and/or prescreen credit cards) takes less than about 10 seconds, and in an advantageous embodiment, takes less than about 1-3 seconds.

Figure 2:
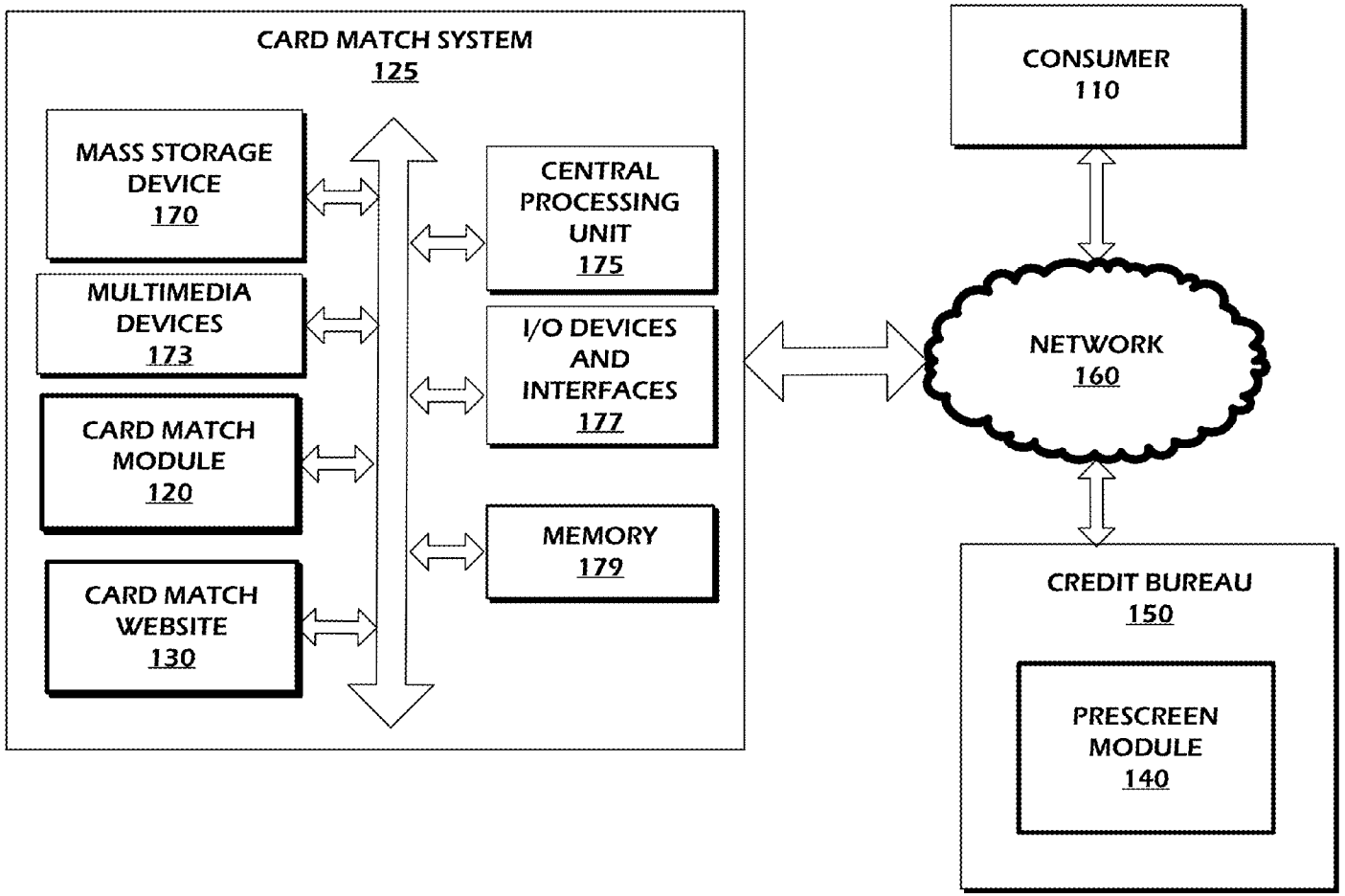
FIG. 2 is a block diagram illustrating one embodiment of a card match system 125 in communication with a credit bureau 150, which includes the prescreen module, via a network.

FIG. 2 is a block diagram illustrating one embodiment of a card match system 125 in communication with a credit bureau 150 that includes the prescreen module 140 via a network 160. Depending on the embodiment, the card match system 125 may include separate computing devices, such as servers, or may include software, firmware, and/or hardware that are resident on a single computing device. In one embodiment, the card match system 125 includes, for example, a server or a personal computer that is Windows, Macintosh, or Linux/Unix compatible. In another embodiment, the card match system 125 comprises a laptop computer, cell phone, personal digital assistant, kiosk, or audio player, for example. In one embodiment, the illustrative card match system 125 includes a central processing unit ("CPU") 175, which may include one or more conventional microprocessor. The CPU 175 may execute one or more modules, such as the card match module 120 and/or the card mach website 130. The illustrative card match system 125 further includes a memory 179, such as random access memory ("RAM") for temporary storage of information and/or a read only memory ("ROM") for permanent storage of information, and a mass storage device 170, such as a hard drive, diskette, flash drive, and/or optical media storage device. The memory 179 and/or the mass storage 170 device may store data in one or more data structures. Data structures may be an electronic, mathematical, and/or logical structure, such as a list, array, tree, or graphic tree, for example.

The card match system 125 is generally controlled and coordinated by operating system software, such as the Windows 95, 98, NT, 2000, XP, Vista, Linux, SunOS, Solaris, PalmOS, Blackberry, or other compatible operating systems. In Macintosh systems, the operating system may be any available operating system, such as MAC OS X. In other embodiments, the card match system 125 may be controlled by a proprietary operating system. Conventional operating systems control and schedule computer processes for execution, perform memory management, provide file system, networking, and I/O services, and provide a user interface, such as a graphical user interface ("GUI"), among other functions.

The card match system 125 may include one or more input/output (I/O) devices and interfaces 177, such as a keyboard, mouse, touchpad, and printer. In one embodiment, the I/O devices and interfaces 177 include one or more display devices, such as a monitor, that allows the visual presentation of data to a user. More particularly, a display device provides for the presentation of GUIs, application software data, and multimedia presentations, for example. In the embodiment of FIG. 2, the I/O devices and interfaces 177 provide a communication interface to various external devices, such as via the network 160. The card match system 125 may also include one or more multimedia devices 173, such as speakers, video cards, graphics accelerators, and microphones, for example.

The card match system 125 also includes a card match module 120 and a card match website 130. The card match module 120 and card match website 130 may store and access data stored in the memory 179 or the mass storage device 170. In general, the word module, as used herein, refers to logic embodied in hardware or firmware, or to a collection of software instructions, possibly having entry and exit points, written in a programming language such as, for example, C, C++, and C#. A software modules may be complied and linked into an executable program, installed in a dynamic link library, or may be written in an interpreted programming language such as, for example, BASIC, Java, Perl, or Python. It will be appreciated that software modules may be callable from other modules or from themselves or may be invoked in response to detected events and interrupts, or both. Software instructions may be embedded in firmware, such as an EPROM. It will be further appreciated that hardware modules may be comprised of connected logic units, such as programmable gate arrays or processors. The modules described herein are preferably implemented as software modules, but may be represented in hardware or firmware. Generally, the modules described herein refer to logical modules that may be combined with other modules or devices into sub-modules despite their physical organization or storage.

In the embodiment illustrated by FIG. 2, the credit bureau 150 comprises the prescreen module 140. The card match module 120 may send a prescreen request to the credit bureau 150, and the prescreen module 140 on the credit bureau 150 may then perform the prescreen process and return the results to the card match system 125.

Figure 3:
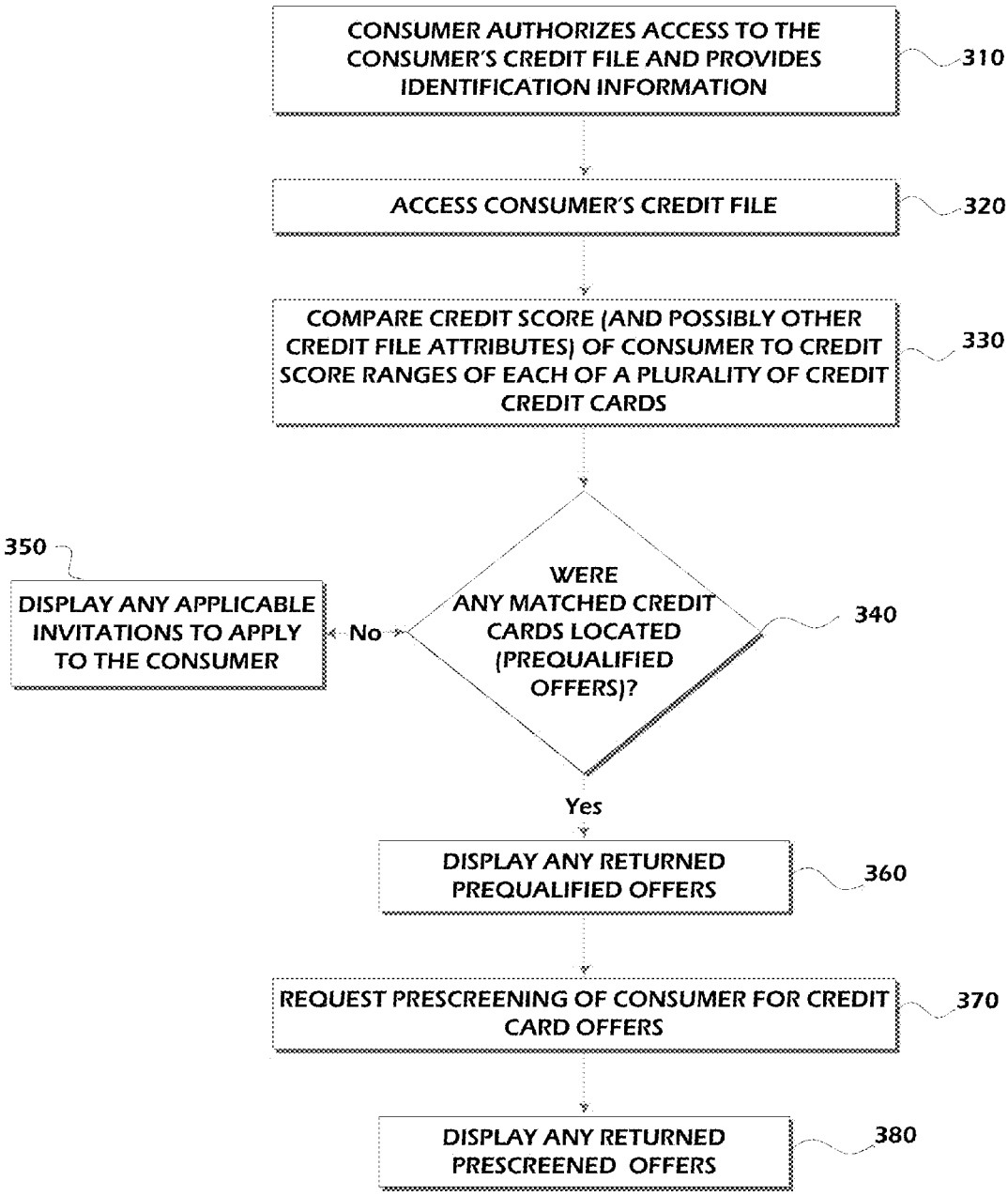
FIG. 3 is a flowchart illustrating one embodiment of a method of providing a consumer with credit card referrals from both a prequalification credit card matching process and a prescreen credit card matching process.

FIG. 3 is a flowchart illustrating one embodiment of a method of providing a consumer with credit card referrals from both a prequalification credit card matching process and a prescreen credit card matching process. In one embodiment, the method of FIG. 3 is performed by the card match system 125 (FIG. 1A or 2) or the credit bureau 150A (FIG. 1B). In other embodiments, the method of FIG. 3 may be performed by any other entity. Depending on the embodiment, the method of FIG. 3 may include fewer or additional blocks and the blocks made be performed in a different order.

Figure 8:
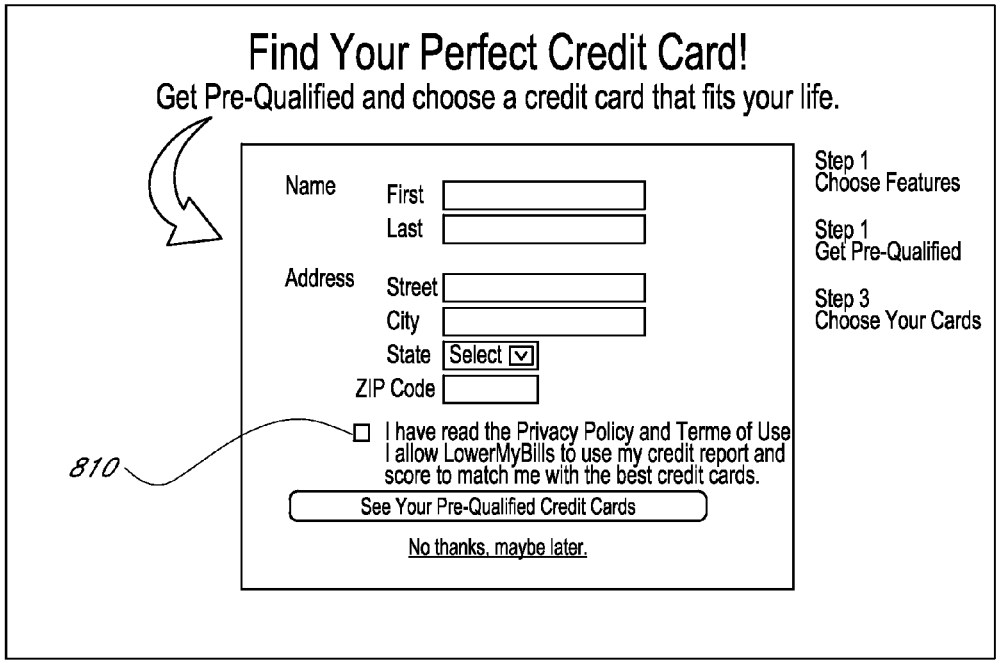
FIG. 8 is a sample screen shot illustrating one embodiment of a web interface for receiving consumer identification information.

Beginning in block 310, a consumer authorizes access to the consumer's credit file, for example to perform a prequalification process, and provides consumer identification information. The prequalification process request may present a compelling reason for the consumer to provide personal information. In one embodiment, the consumer identification information may be provided via a website provided by a card match system, credit bureau, or other entity. For example, FIG. 8 is a sample screen shot illustrating one embodiment of a web interface for receiving consumer identification information. In the embodiment of FIG. 8, the user interface includes fields for receiving a consumer's first name, last name, street, city, state, and zip code. Additionally, the user interface includes a checkbox 810 that allows the consumer to authorize the card match system, for example, to use the consumer's credit report and to match the consumer with prequalified credit cards. Thus, by checking the box 310, the consumer authorizes the card match system to perform the subsequent prequalification process. In other embodiments, the consumer data may be received in user interfaces of any other type, including a conversation with an employee associated with the card match system 125, and the user interfaces may request less or additional information then the user interface of FIG. 8.

Figure 6:
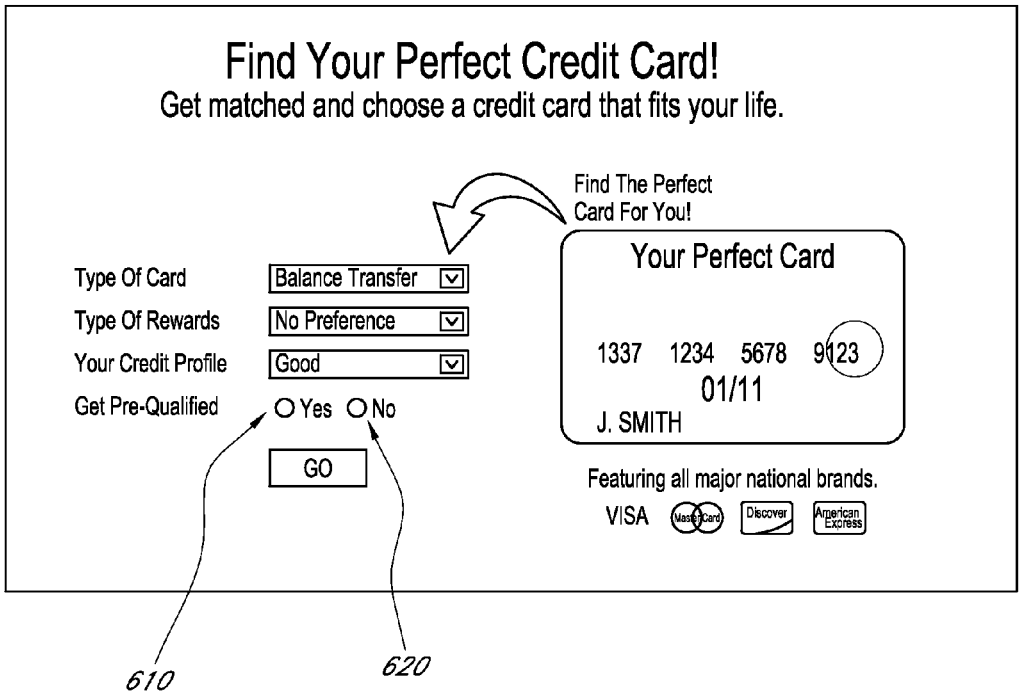
FIG. 6 is a sample screen shot illustrating one embodiment of a landing page that may be initially provided to consumers to allow them to select criteria for cards in which they are interested in applying.

Depending on the embodiment, the consumer may reach the identification input interface (e.g., FIG. 8), from a number of previous pages. For example, FIG. 6 is a sample screenshot illustrating one embodiment of a landing page of a card match system that may be initially provided to consumers to allow them to select criteria for cards in which they are interested in applying. In the embodiment of FIG. 6, the landing page allows the consumer to select a type of card, type of reward, and to provide a credit profile of the consumer. Additionally, the landing page of FIG. 6 provides a get prequalified option for the consumer. In this embodiment, if the consumer selects the "get prequalified" radio button 610, the consumer is asked for additional identification information, such as via a user interface similar to that of FIG. 8. Alternatively, if the consumer selects the "no" radio button 620, or does not select either of the radio buttons 610, 620, the consumer may simply be provided with one or more invitations to apply for credit cards that match the credit card preferences provided by the consumer on the landing page (e.g., not the actual consumer credit data from a credit bureau).

Figure 7:
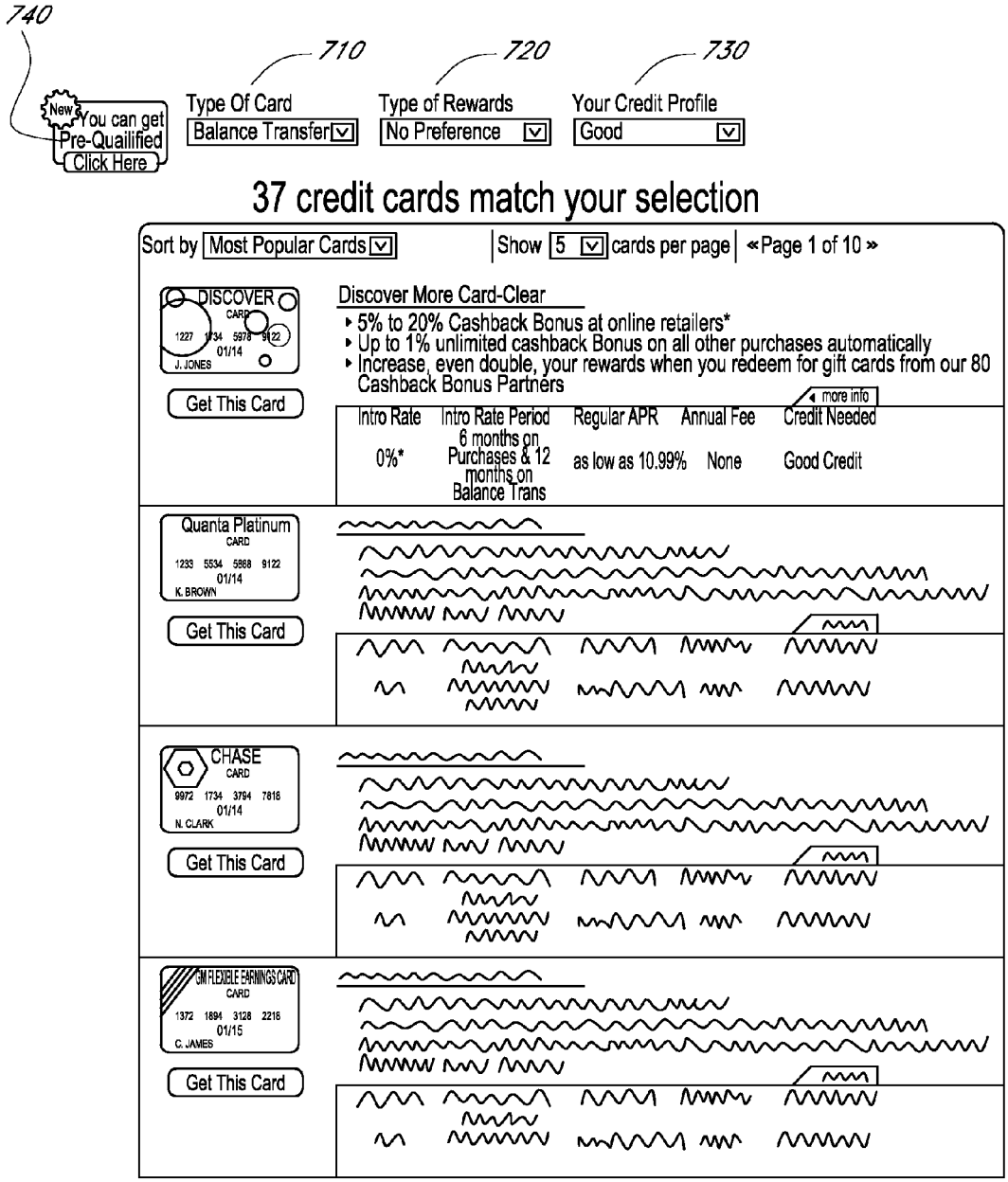
FIG. 7 is a sample screen shot illustrating one embodiment of a user interface that provides the consumer with multiple invitations to apply for credit cards.

FIG. 7 is a sample screen shot llustrating one embodiment of a user interface that provides the consumer with multiple invitations to apply for credit cards, wherein the listed invitations to apply are not based on actual credit bureau data associated with the consumer, but rather on data supplied by the consumer, such as a credit card preference data including a type of card 710, a type of reward 720, as well as a consumer-selected credit profile 730. In the embodiment of FIG. 7, the consumer may indicate their desire to be prequalified for credit cards by selecting button/icon 740, which results in the consumer receiving a request for further identification information, such as the information indicated in FIG. 8, as well as authorization from the consumer to access the consumer's credit file.

Returning to FIG. 3, in block 320 the consumer's credit file is accessed by the card match system. For example, the card match system may request a credit file of the consumer from a credit bureau via a network. Alternatively, if the card match module is part of a credit bureau, the card match module may simply access the credit file as stored by the credit bureau. In some embodiments, only a portion of the credit file, for example the credit score of the consumer, is accessed.

Figure 9:
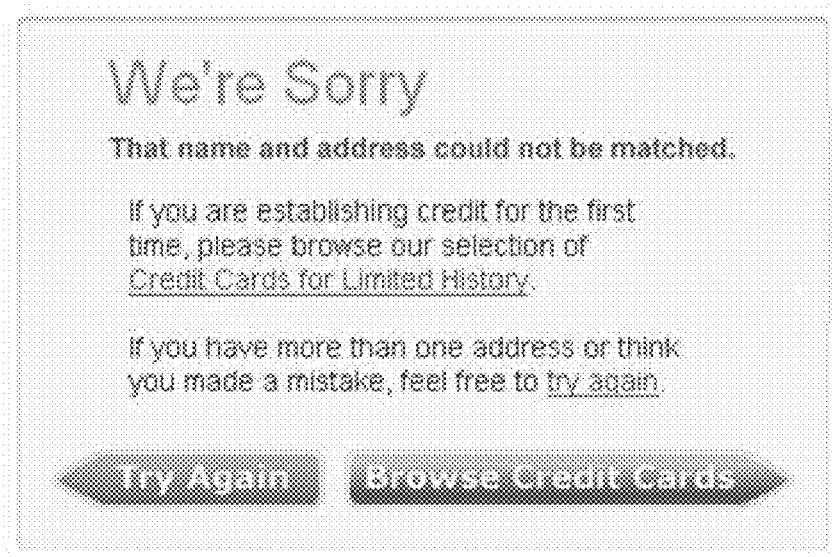
FIG. 9 is a sample screen shot illustrating an embodiment of a user interface that presents an error message.
Figure 10:
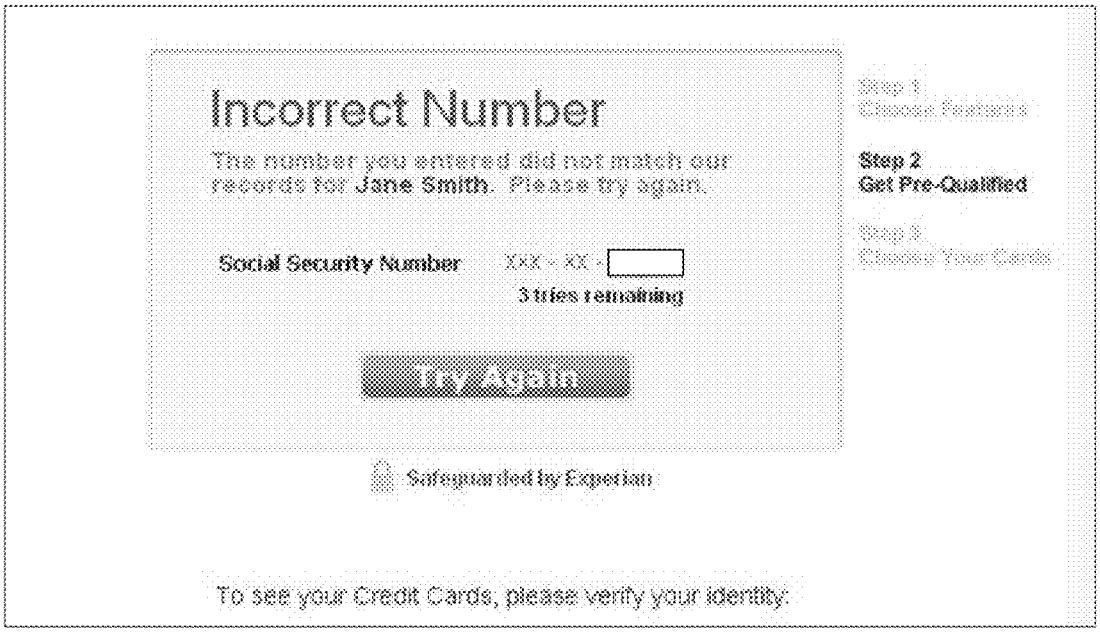
FIG. 10 is an exemplary user interface that requests the last four digits of the consumer's Social Security number

In one embodiment, if a credit file for the consumer is not located by the credit bureau, the consumer is presented with an error message. FIG. 9 is a sample screen shot illustrating an embodiment of a user interface that presents an error message. In certain embodiments, the consumer is required to enter authentication information to confirm that the proper credit file is accessed. For example, FIG. 10 is an exemplary user interface that requests the last four digits of the consumer's Social Security number, which may then be compared to the Social Security number on the returned credit file in order to confirm that the appropriate credit file has been accessed. In other embodiments, other types of authentication information may be requested from the consumer or no authentication information may be requested.

Moving to block 330, the credit score of the consumer may be compared to credit score ranges associated with of each of the plurality of credit cards. For example, the card match system may segment the consumer into one or more credit tiers based on the returned credit score of the consumer, where each of the tiers may include a range of credit scores. The card match system may determine the range of credit scores associated with each of the different tiers. Additionally, each tier may be associated with zero or more credit cards for which the consumer may be qualified. Thus, by matching the consumer with a tier, the card match system may determine those credit cards which the consumer would likely be granted (upon full application with the respective credit card issuer, for example).

In one embodiment, the credit cards associated with the respective tiers comprise credit cards from multiple issuers and/or a plurality of card types. Accordingly, the card match system may determine credit cards from a plurality of issuers and a plurality of card types that the consumer would likely be granted. In other embodiments, a subset of the attributes in the credit file of the consumer other than (or in addition to) the credit score may be compared to acceptable ranges of the one or more attributes for each of the plurality of credit cards. These attributes may include monthly income, number of credit cards open, the age of the consumer, how long the consumer has resided in their current residence, or any other attribute in the credit file. Accessing only a subset of the attributes in the credit file may incur a lesser expense than accessing the entire credit file, advantageously providing a less expensive way to match a consumer to one or more credit cards without incurring a greater expense by performing a prescreening.

Next, in block 340 the card match system determines if there are any matched prequalified offers for the consumer. If there are no prequalified offers, the method continues to block 350 where invitations to apply for credit cards are optionally displayed to the consumer. As noted above, invitations to apply for credit cards may be based on information supplied by the consumer, such as a desired type of card, a desired type of reward, and/or a consumer selected credit profile. However, because invitations to apply are not based on the actual credit attributes of the consumer, the acceptance rates for applications completed in response to invitations to apply are much lower than acceptance rates in response to prequalification or prescreen credit card offers. If one or more prequalified offer was located in block 330, then the method continues to block 360.

In block 360 the consumer is provided with indications of the prequalified offers. The indications may be provided over a web accessible user interface, such as a web site, or via other channels, including, for example, email and/or SMS message. The prequalified offers may be provided to the consumer regardless of the outcome of any prescreening that may be later performed on the consumer's credit file. Thus, even if a consumer does not qualify for a prescreened offer, the consumer may still receive one or more prequalified offers. In one embodiment, the prequalified offers are presented to the consumer along with any returned prescreened offers (block 380), after the prescreening has been performed on the consumer. Thus, in one embodiment the process of block 360 is combined with the process of 380.

Next, if a minimum threshold of prequalified offers, for example one or more offers, is located in block 330, the method continues to block 370, where a prescreen request for the consumer is initiated. In one embodiment, consumer authorization is not obtained to perform the prescreen process and the consumer is not notified that the prescreen process will be performed. The prescreen process may be performed by a prescreen module, such as might be maintained by a credit bureau. In one embodiment, in response to federal regulations, a consumer may not be notified that the prescreen process is being performed. Additionally, the same federal regulations may require that any prescreen matches must be presented to the consumer as firm offers of credit to the consumer.

In one embodiment, the prescreen module 140 accesses the consumer's credit file and may match multiple attributes of the consumer's credit file with acceptable ranges of the respective attributes that are associated with each of a plurality of credit cards. Thus, as opposed to block 330, in which a subset of the attributes of the credit file, for example one attribute (e.g., the credit score), are used to match consumer attributes to the attributes of each of the plurality of credit cards, a more comprehensive comparison may be performed. The attributes may include repayment history, employment history, longevity in the current residence, total revolving debt, credit score, name of bank(s), current cards held, re-aging, utilization, credit inquiries, number of accounts, type of accounts, age of accounts, credit limits, court records, tax liens, money judgments, and bankruptcies. Also, since the credit card issuer may provide the criteria rather than the card match system, a match of the prescreen criteria of a credit card may indicate a greater likelihood of a consumer being approved for the credit card upon application for the credit card. The prescreen process may cost more to perform than the prequalification process, therefore performing the prescreen only in response to identifying a predetermined minimum prequalified offers may increase the likelihood of the prescreen process returning a prescreened offer, which in turn increases the likelihood of a return on investment for the greater cost by increasing the likelihood that the consumer's application for a credit card (that is matched by the prescreened process) will be approved. It may also advantageously reduce costs that would otherwise be incurred by performing prescreening processes that do not return a prescreened offer.

Figure 11:
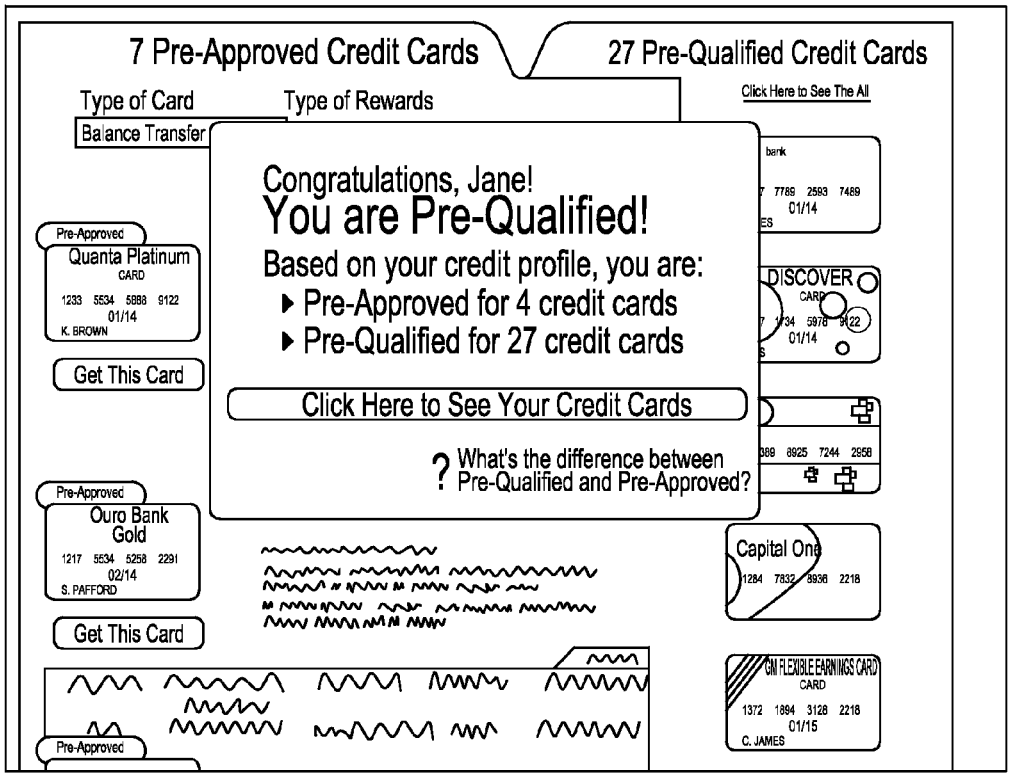
FIG. 11 is a sample screen shot illustrating a user interface that indicates to the consumer a quantity of prequalified and prescreened (referred to in FIG. 11 as pre-approved) credit card offers.

Next, in block 360 the consumer is provided with indications of any prescreened offers. The indications of prescreened offers may be presented with the prequalified offers. If no prescreened offers were found, the consumer may receive only the indications of the prequalified offers. FIG. 11 is a sample screen shot illustrating one embodiment of a user interface that indicates to the consumer a quantity of prequalified and prescreened (referred to in FIG. 11 as "pre-approved") credit cards. As illustrated in FIG. 11, the consumer ("Jane") was matched with 27 prequalified credit cards, but only matched with 4 prescreened credit cards. Thus, the quantity of prescreen offers for Jane is much lower than the number of prequalified offers. Advantageously, because the prescreened offers are based on multiple credit related attributes in addition to the credit score, though the prescreen offers are fewer than the prequalified offers they also have a much higher average acceptance rate than the prequalified offers.

Figure 12:
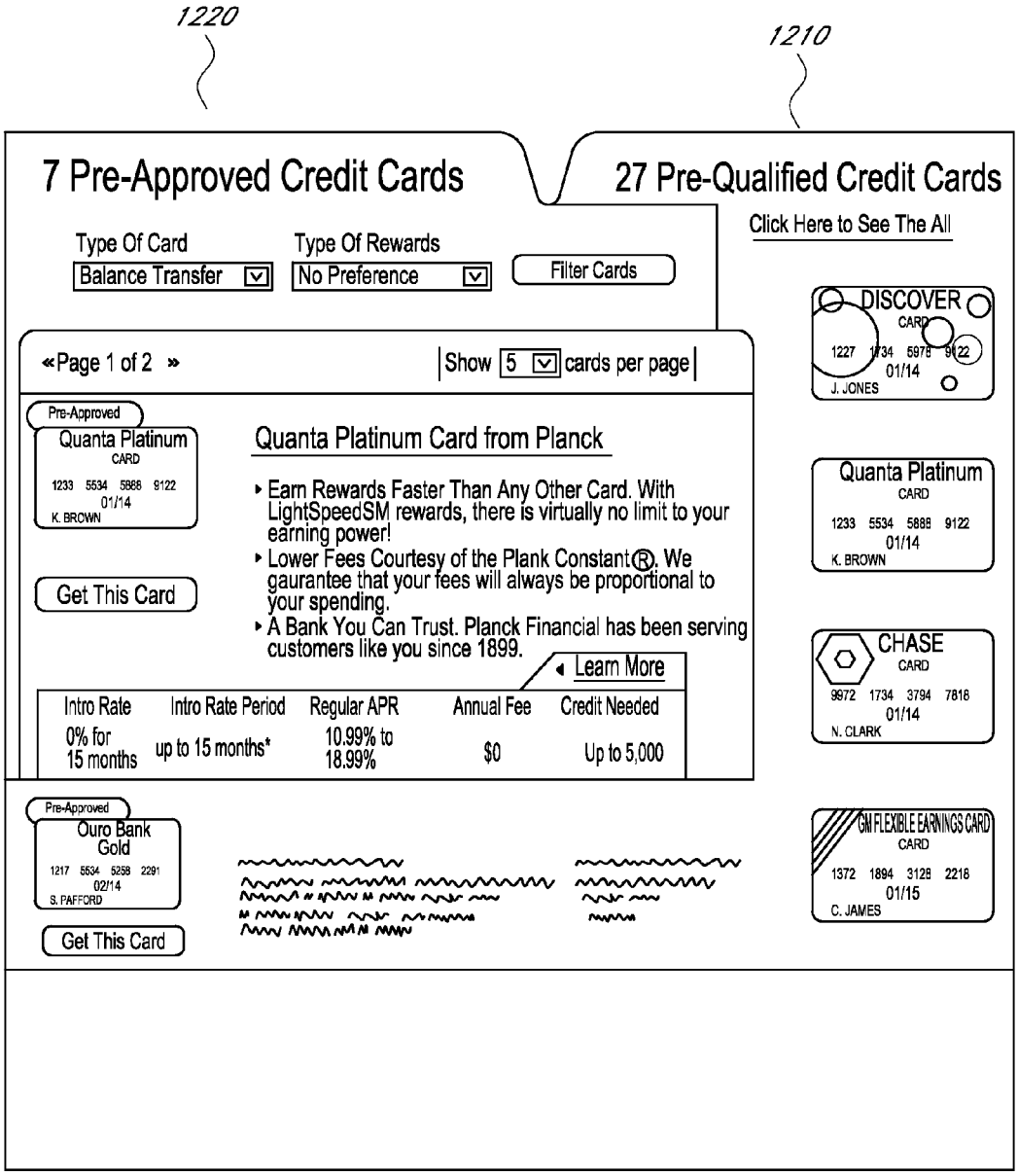
FIG. 12 is a sample screen shot illustrating one embodiment of a user interface that presents the prequalified and prescreened credit card offers to the consumer.

FIG. 12 is a sample screen shot illustrating one embodiment of a user interface that presents the prequalified and prescreened credit card offers to the consumer. In the embodiment of FIG. 12, a prequalification tab 1210 may be selected by the consumer in order to view the prequalified offers, and a prescreen tab 1220 may be selected by the consumer in order to view the prescreened credit card offers. The consumer may choose to apply for one of the indicated credit cards by selecting a link associated with a desired credit card. FIG. 13 is one embodiment of a user interface that displays more information regarding certain of the displayed credit cards that may be provided to the consumer.

Figure 4:
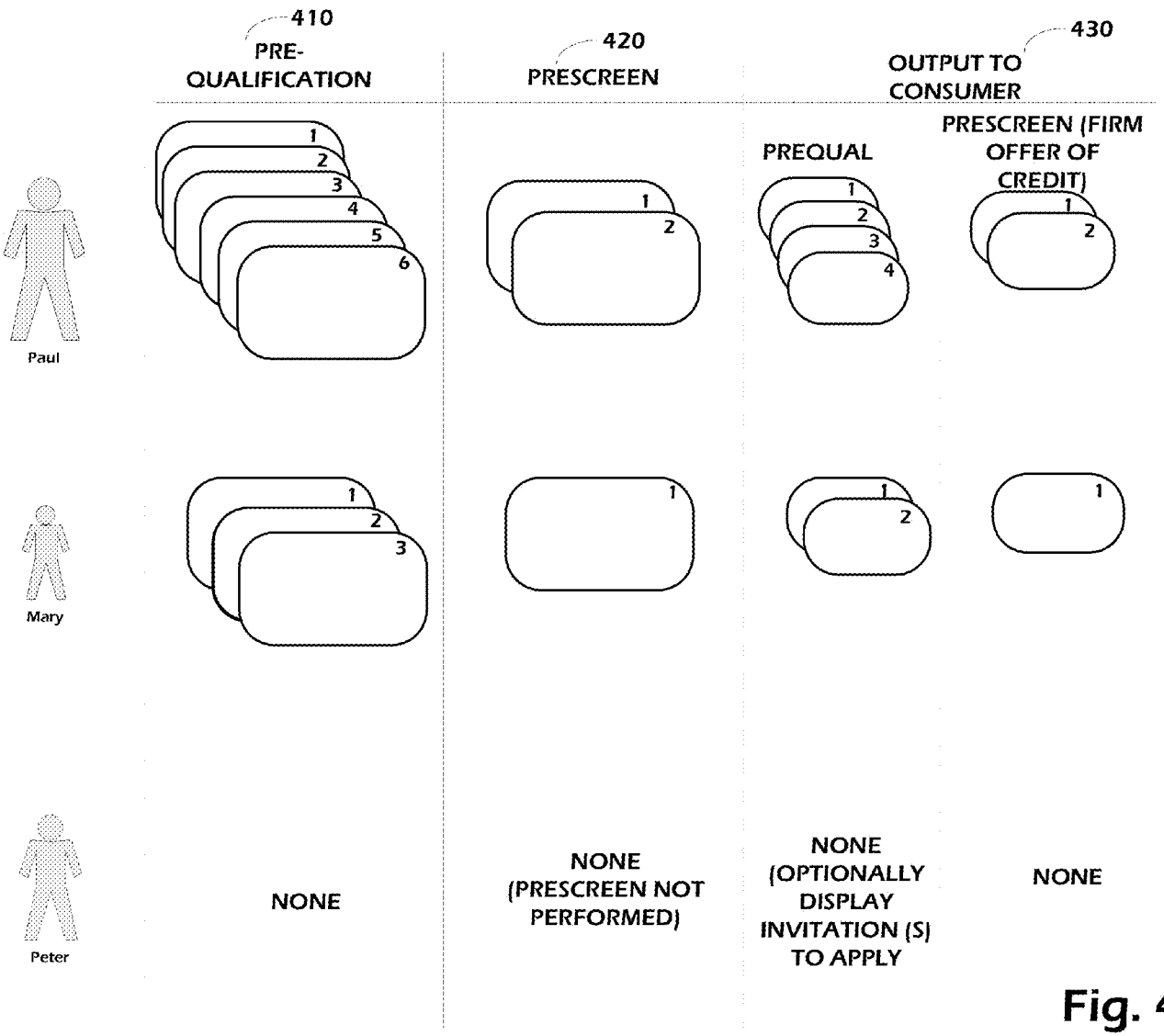
FIG. 4 is a diagram illustrating three exemplary consumers along with exemplary quantities of matched offers located and presented to the consumers.

FIG. 4 is a diagram illustrating three exemplary consumers Paul, Mary, and Peter, along with exemplary quantities of matched offers for the consumers that were located at each of the prequalification and prescreen processes and that are presented to the respective consumers. As noted above, once the consumer has provided authorization for the card match system to access the consumer's credit file, the prequalification process retrieves and/or accesses the consumer's credit score in order to match the consumer to one or more prequalified offers. In the example of FIG. 4, Paul's credit score was within the acceptable credit score range for six credit cards, Mary's credit score was in the acceptable credit score range for three credit cards, and Peter's credit score was outside the acceptable credit score range for all of the credit cards for which the card match system performed the prequalification process. Because Paul and Mary were each prequalified for at least one credit card, the card match system may then request a prescreen for each of Paul and Mary, without notifying Paul or Mary that the prescreen has been requested and/or without receiving authorization from Paul or Mary to request the prescreen. Because Peter was not prequalified for any credit cards, a prescreen is not requested for Peter.

As indicated in the prescreen column 420, the exemplary prescreen results indicate that Paul is prescreened (or pre-approved) for two credit cards, while Mary is prescreened (or pre-approved) for one credit card. Because no prescreen was performed on Peter, Peter is not preapproved for any credit cards. In column 430, the content of an exemplary output to the consumer is provided. In particular, the output provided to Paul indicates the two credit cards for which Paul was preapproved, in addition to the remaining four credit cards for which Paul was only prequalified. In general, Paul has a much higher chance of being granted one of the preapproved credit cards than the prequalified credit cards. Accordingly, the card match system may provide the prescreen offers to the consumer first, or more prominently, in hopes that the consumer applies for one or more of the prescreen offers (rather than one of the prequalified offers). With reference to Mary, she may be provided with an indication of the one pre-screen offer, as well as the remaining two prequalified offers. With reference to Peter, since no prequalified or prescreen offers were located for Peter, the card match system may optionally present Peter with one or more invitations to apply for credit cards that are selected based on card preferences supplied by Peter, for example.

Figure 5:
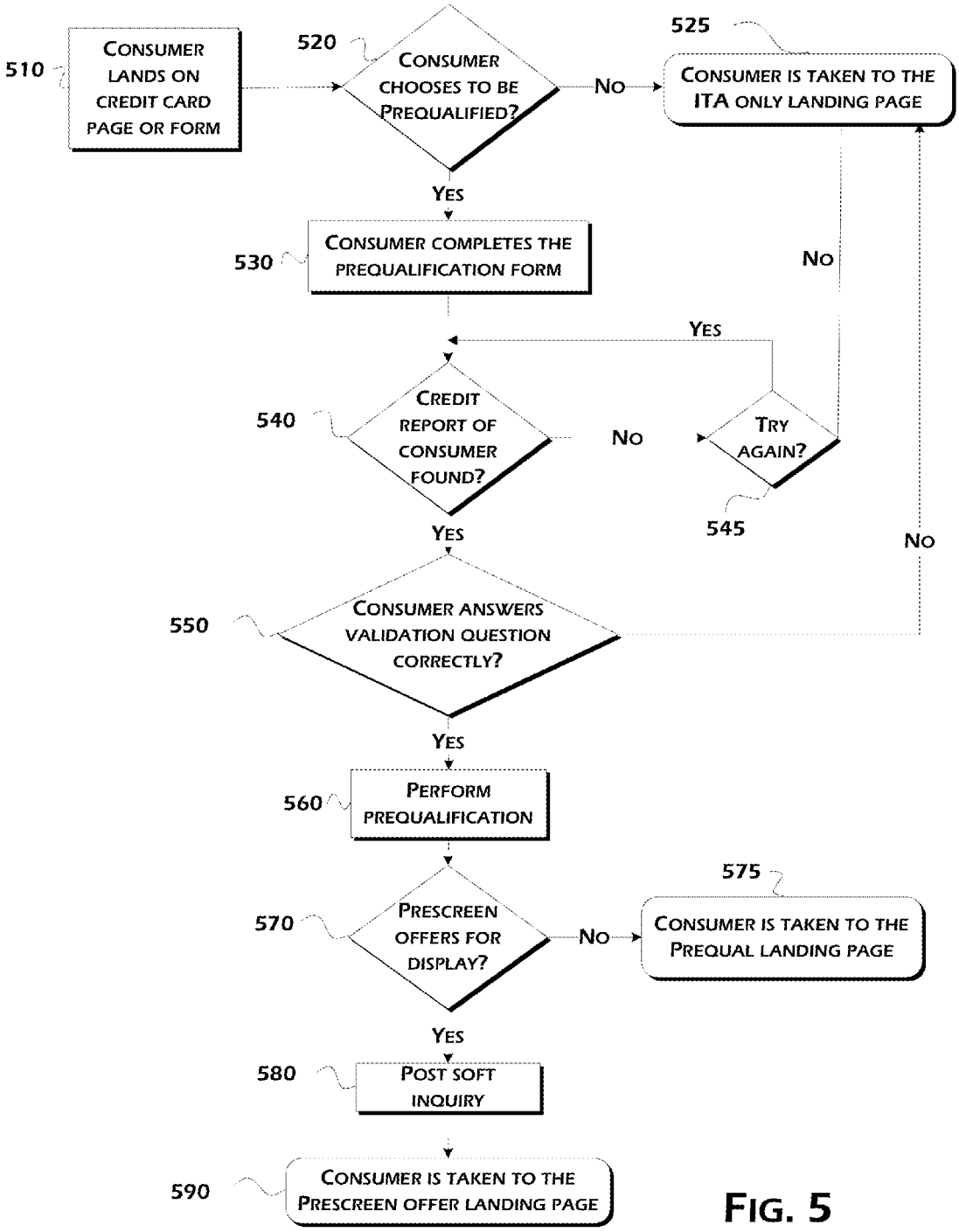
FIG. 5 is a flowchart illustrating another embodiment of providing a consumer with credit card referrals from both a prequalification credit card matching process and a prescreen credit card matching process.

FIG. 5 is a flowchart illustrating another embodiment of providing a consumer with credit card referrals from both a prequalification credit card matching process and a prescreen credit card matching process. Depending on the embodiment, the method of FIG. 5 may include additional or fewer blocks and blocks may be performed in a different order.

Beginning in block 510, a consumer lands on a credit card page or form. Via the page or form, in block 520 the consumer may choose to be prequalified for one or more credit cards. The consumer may specify the one or more credit cards or the card match module may select the one or more credit cards for which prequalification will be performed, or prequalification may be performed for an entire set of credit cards. If the consumer chooses to be prequalified, the method proceeds to block 530. If the consumer chooses not to be prequalified, then the method proceeds to block 525, when the consumer is taken to the ITA only landing page where the consumer is given invitations to apply for one or more credit cards.

In block 530, the consumer completes the prequalification form to provide consumer identification information to allow the prequalification to be performed. Next, in block 540 the credit report of the consumer is attempted to be found. If the credit report is not found, then the consumer is taken to an error page in block 545 where they can provide the information again. If the consumer provides the information again the method returns to block 540 and again tries to find the credit report of the consumer, otherwise the method proceeds to block 525 and the consumer is taken to the ITA only landing page.

If the credit report is found in block 540, the method proceeds to block 550. In block 550 the consumer is asked to answer a validation question in order to verify the identity of the consumer. If the consumer does not answer the validation question correctly, the method proceeds to block 525. If the consumer answers the validation question correctly, then the method proceeds to block 560 where the prequalification is performed. Next, in block 570, the prescreen may be performed. For example, if the consumer is prequalified for a predetermined number of credit cards in block 560, then the prescreen may be performed. If the consumer is not matched with any credit cards during the prescreen or the prescreen is not performed, then in block 575 the consumer is taken to the prequal landing page where the consumer is presented with indications of any prequalified offers. If the consumer is matched with one or more cards during a prescreen, then in block 580 a soft inquiry is posted to the consumer's credit file, and in block 590 the consumer is taken to the prescreen offer landing page where the consumer is presented with indications of the prescreen offers (and in some embodiments, with indications of the one or more prequalification offers as well).

Although the foregoing invention has been described in terms of certain embodiments, other embodiments will be apparent to those of ordinary skill in the art from the disclosure herein. Moreover, the described embodiments have been presented by way of example only, and are not intended to limit the scope of the inventions. Indeed, the novel methods and systems described herein may be embodied in a variety of other forms without departing from the spirit thereof. Accordingly, other combinations, omissions, substitutions and modifications will be apparent to the skilled artisan in view of the disclosure herein. Thus, the present invention is not intended to be limited by the preferred embodiments, but is to be defined by reference to the appended claims.

What is claimed is:

1. A computerized method for providing credit card offers to a consumer, the method comprising:

receiving consumer identification information associated with a consumer from an interface;

storing the consumer identification information in a computer readable medium;

retrieving, by a computing system, a credit score associated with the consumer in response to receiving a consumer request to match the consumer to one or more credit cards;

storing the credit score in a computer readable medium;

determining one or more prequalified credit card offers for the consumer for one or more credit cards based on the credit score being within acceptable credit score ranges associated with the respective one or more credit cards;

in response to determining, by the computing system, that the credit score is within an acceptable credit score range for a threshold quantity of credit cards, automatically performing without notifying the consumer:

initiating transmission, by the computing system, of a request for a prescreening of the consumer to a prescreening device, wherein the request includes at least some of the consumer identification information received from the consumer as part of the consumer's request to match the consumer to one or more credit cards, and wherein prescreening of the consumer comprises determining whether the consumer qualifies to receive a firm offer of credit for one or more credit cards; and receiving, by the computing system, indications of any prescreened credit card offers for the consumer from the prescreening device; and generating, by the computing system, a user interface indicating the prequalified credit card offers and the prescreened credit card offers for transmission to a computing device associated with the consumer, wherein each of the prescreened credit card offers comprises a firm offer of credit to the consumer and each of the prequalified credit card offers do not comprise a firm offer of credit to the consumer.

2. The method of claim 1, wherein the method is performed in substantially real-time.

3. The method of claim 1, further comprising determining the acceptable credit score ranges associated with the respective one or more credit cards.

4. The method of claim 1, further comprising:

receiving indications of desired attributes of a credit card from the consumer;

determining one or more credit cards that match the desired attributes; and initiating transmission of indications of the one or more credit cards that match the desired attributes.

5. The method of claim 4, wherein the consumer is more likely to be approved for a prescreened credit card associated with a prescreened offer upon applying for the prescreened credit card than to be approved for a prequalified credit card associated with a prequalified offer upon applying for the prequalified credit card.

6. The method of claim 1, wherein no indication of the prescreen request is provided to the consumer.

7. The method of claim 1, wherein the threshold number of credit cards is one.

8. The method of claim 1, wherein a cost of prescreening the consumer is a multiple of 5-10 times more than a cost of retrieving the credit score associated with the consumer and determining one or more prequalified credit card offers for the consumer.

9. A system for providing credit cards offers to a consumer, the system comprising:

a processor;

a computer readable memory storing acceptable credit score ranges associated with respective one or more credit cards;

an interface module configured to receive authorization to retrieve a credit score associated with a consumer to match the consumer to the one or more credit cards;

a card match module configured to retrieve the credit score associated with the consumer;

match one or more prequalified credit card offers to the consumer based on the credit score being within the acceptable credit score ranges associated with the respective one or more credit cards;

initiate transmission of a request to match the consumer to or more prescreened credit card offers to a prescreening device; and receive indications of any matched prescreened credit card offers for the consumer from the prescreening device.

10. The system of claim 9, further comprising:

an interface module configured to initiate transmission of indications of any matched prequalified credit card offers and any matched prescreened credit card offers to a consumer computing device.

11. The system of claim 9, wherein the prescreening device receives prescreening criteria from one or more credit card issuers.

12. The system of claim 11, wherein the criteria includes one or more of repayment history, employment history, longevity in the current residence, total revolving debt, credit score, name of bank(s), current cards held, re-aging, utilization, credit inquiries, number of accounts, type of accounts, age of accounts, credit limits, court records, tax liens, money judgments, and bankruptcies.

13. The system of claim 11, wherein the card match module is further configured to determine the acceptable credit score ranges associated with the respective one or more credit cards.

* * * * *

UNITED STATES PATENT AND TRADEMARK OFFICE

CERTIFICATE OF CORRECTION

PATENT NO. : 8,412,593 B1
APPLICATION NO. : 12/575404
DATED : April 2, 2013
INVENTOR(S) : Song et al.

It is certified that error appears in the above-identified patent and that said Letters Patent is hereby corrected as shown below:

On the Title Page

In column 1 (page 4 item 56) at line 21, Under Other Publications, change "Respresentatives," to --Representatives,--.

In column 1 (page 4 item 56) at line 39, Under Other Publications, change "Particpating" to --Participating--.

In column 1 (page 4 item 56) at line 52, Under Other Publications, change "Science" to --Sciences--.

In column 1 (page 4 item 56) at line 64, Under Other Publications, change "Parters" to --Partners--.

In column 2 (page 4 item 56) at line 7, Under Other Publications, change "Acutal" to --Actual--.

In column 2 (page 4 item 56) at line 11, Under Other Publications, change "Comsumer" to --Consumer--.

In column 2 (page 4 item 56) at line 19, Under Other Publications, change "Steakehouse" to --Steakhouse--.

In column 2 (page 4 item 56) at line 20, Under Other Publications, change "Moble" to --Mobile--.

In column 2 (page 4 item 56) at line 26, Under Other Publications, change "release/" to --releases/--.

In column 2 (page 5 item 56) atline 2, Under Other Publications, change "CHIEFMARKERTER.COM,' to --CHIEFMARKETER.COM,--.

In column 2 (page 5 item 56) at line 43, Under Other Publications, change "1966," to --1996,--.

In column 2 (page 5 item 56) at line 63, Under Other Publications, change "Decision" to --Decisions--.

In column 1 (page 6 item 56) at line 10, Under Other Publications, change "Costmetic" to --Cosmetic--.

In column 1 (page 6 item 56) at line 14, Under Other Publications, change "Electric" to --Electronic--.

Signed and Sealed this
First Day of October, 2013

Teresa Stanek Rea
*Deputy Director of the United States Patent and Trademark Office*

In column 2 (page 6 item 56) at line 20, Under Other Publications, change "zoot.web.com/" to --zootweb.com/--.

In the Drawings

Sheet 4 of 14 (Reference Numeral 330, Fig. 3) at lines 3-4, Change "CREDIT CREDIT CARDS" tc --CREDIT CARDS--.

Sheet 8 of 14 (Reference Numeral 740, Fig. 7) at line 2, Change "Quailified" to --Qualified--.

Sheet 9 of 14 (Reference Numeral 810, Fig. 8) at line 1, Change "Terme" to --Terms--.

Sheet 13 of 14 (Fig. 12) at line 20, Change "gaurantee" to --guarantee--.

In the Specification

In column 2 at line 67, Change "number" to --number.--.

In column 9 at line 59, Change "llustrating" to --illustrating--.

In the Claims

In column 15 at line 22, In Claim 9, change "or" to --one or--.